US006332705B1

(12) United States Patent
Herz et al.

(10) Patent No.: US 6,332,705 B1
(45) Date of Patent: Dec. 25, 2001

(54) STIRRING DEVICE WITH VESSEL CENTERING AND STABILIZING MEANS

(76) Inventors: Helmut Herz, Lauterbachstrasse 14, D-80997 Munich (DE); Klaus Kaufmann, Bruckmannring 28, D-85764 Oberschleissheim (DE)

( * ) Notice: Subject to any disclaimer, the term of this patent is extended or adjusted under 35 U.S.C. 154(b) by 0 days.

(21) Appl. No.: 09/380,538

(22) PCT Filed: Mar. 6, 1998

(86) PCT No.: PCT/EP98/01303

§ 371 Date: Dec. 10, 1999

§ 102(e) Date: Dec. 10, 1999

(87) PCT Pub. No.: WO98/39089

PCT Pub. Date: Sep. 11, 1998

(30) Foreign Application Priority Data

| | | |
|---|---|---|
| Mar. 6, 1997 | (DE) | 197 09 236 |
| Mar. 6, 1997 | (DE) | 197 09 237 |
| Jun. 7, 1997 | (DE) | 197 24 046 |

(51) Int. Cl.[7] ..... B01F 9/10

(52) U.S. Cl. ..... 366/208; 366/213; 366/214; 366/232; 366/220; 366/144

(58) Field of Search ..... 366/319, 219, 366/220, 232, 208, 213, 214, 273, 274, 144

(56) References Cited

U.S. PATENT DOCUMENTS

| | | | |
|---|---|---|---|
| 3,627,276 | | 12/1971 | Gilford . |
| 4,345,843 | * | 8/1982 | Berglund et al. . |
| 4,390,283 | | 6/1983 | Meyer . |
| 5,195,825 | * | 3/1993 | Ringrose . |
| 5,399,013 | * | 3/1995 | Sawyer . |

FOREIGN PATENT DOCUMENTS

| | | |
|---|---|---|
| 94 06 450.4 | 9/1994 | (DE) . |
| 297 09 966 | 8/1997 | (DE) . |
| 0 035 762 | 9/1981 | (EP) . |

* cited by examiner

*Primary Examiner*—Joseph W. Drodge
*Assistant Examiner*—Terry K. Cecil
(74) *Attorney, Agent, or Firm*—Hamilton, Brook, Smith & Reynolds, P.C.

(57) ABSTRACT

A device for stirring, mixing, and agitating liquids includes a vessel 1 having vertical supporting elements (2, 5) to support at least part of the weight of the vessel, rotational holding elements (7, 8) for positioning and guiding the vessel as it rotates around its essentially vertical symmetrical axis, and driving elements (3, 4) for rotating the vessel. The rotational holding elements are provided with centering and stabilizing devices (9, 10) which exert in a clearance S between the rotational holding devices and an outer wall of the vessel, centering and stabilizing forces acting on the vessel.

47 Claims, 15 Drawing Sheets

STIRRING DEVICE WITH VESSEL CENTERING AND STABILIZING MEANS

RELATED APPLICATIONS

This application is the U.S. National Phase of International Application No. PCT/EP98/01303 filed on Mar. 6, 1998, which claims priority to German Application Nos. 197 09 237.3 filed Mar. 6, 1997, 197 09 236.5 filed Mar. 6, 1997, and to 197 24 046.1 filed Jun. 7, 1997, the entire teachings of which are incorporated herein by reference.

BACKGROUND OF THE INVENTION

Devices for stirring liquids are generally known, in which the surface of an appliance base containing a magnetic-field generating system has placed on it a stirring vessel, in which the liquid to be treated is introduced and a magnetic stirring rod is inserted, which interacts with a rotating magnetic driving field generated by the magnetic-field generating system of the appliance base and which stirs the liquid.

In specific instances of use, it may be expedient to avoid the difficulties arising as a result of the separate handling of the stirring rod and the wetting of the latter by the liquid to be treated.

German Utility Model G9406540.4 discloses a magnetic stirring device which, in a plate-shaped base, contains a number of magnetic-field generating systems which generate rotating magnetic fields near the top side of the base. Located on the top side of the base are rotatably mounted vessels, for example in the form of test tubes, which have, near their lower end, a holder containing a magnetic member, the said holder being supported in each case with a bearing pivot point against a step bearing on the top side of the base. The vessels are rotatably mounted near their upper end on a carrier, in such a way that the vessels can be set in rotation by means of the magnetic members which interact with the magnetic rotary fields. If the vessels are driven at a changing rotational speed or in the direction of rotation which, for example, changes periodically, liquid introduced into the vessels undergoes intimate intermixing due to the shearing forces acting in it, since liquid located in the treatment vessel is entrained in the layers adhering to the vessel inner wall, whereas the parts of the liquid volume which are near the axis lag behind during rotation.

It is apparent that the pivot point mounting of the lower vessel end of the holder attached onto the lower vessel end in a bearing depression ensures that a vessel runs centrically in its lower part within a wide rotational speed range, but that the rotary mounting near the upper vessel end tends to run unevenly because of the comparatively large diameter of the vessel, and that undesirable rattling phenomena occur which may ultimately cause the vessel to stop if the driving torque of the magnetic-field generating system is no longer sufficient. A reduction in the bearing play of the upper rotary mounting presents difficulties on account of the tolerances in the diameter of the vessels and may put at risk the smooth movement of the rotary mounting of the vessel as a whole. Undesirable rattling phenomena of the upper rotary mounting are triggered by small unbalances [lacuna] is pressed against a point region of the bearing bore by the centrifugal forces against the vessel outer wall, and the vessel begins to roll on the bearing-bore inner wall under the driving force.

OBJECT OF THE INVENTION

Accordingly, the object of the invention is to design a stirring device in such a way that the vessel experiences smooth vibration-free running within a wide rotational speed range and maintains this property also within a wide range of height of the centre of gravity relative to the vessel. In a further development, the vessel rotational speed range is to be extended beyond 8,000 l/min.

SUMMARY OF THE INVENTION

In a particular refinement of the stirring device, the coupling between the rotating magnetic driving fields generated by the magnetic-field generating system of the drive means and the driving-part arrangement provided in the holding extension of the treatment vessels is improved, and, consequently, not only is the efficiency of the drive increased, but, at the same time, a reliable and low-vibration rotary mounting for operation within a wide rotational speed range also becomes possible.

It may be pointed out, here, that individual features of the embodiments described may, within the scope of the invention, even though not expressly mentioned here, be combined with one another according to the knowledge of the person skilled in the art, and therefore the invention also embraces such combinations.

It should be mentioned, further, that the drawings sometimes show only a single vessel for receiving the liquid to be treated, the said vessel being elongated along an essentially vertical axis of symmetry and having an upper filling orifice, but that, as is known per se, all the embodiments contain a plurality of such vessels capable of being operated parallel to one another and of associated magnetic-field generating systems.

In stirring devices specified here, the rotary mounting means provided near the upper end of the vessel have considerable clearance relative to the vessel outer wall, in such a way that the vessels can easily be inserted into the stirring device or extracted from it again, and this may be carried out automatically by means of a manipulator or robot. Despite this large bearing play, the centring and stabilizing means bring about reliable damping of vibrations and rattling phenomena during the running of the vessels within a wide rotational speed range and also in cases where the centre of gravity of the vessel and filling is relatively high.

BRIEF DESCRIPTION OF THE DRAWINGS

The embodiments are described below with reference to the drawings in which.

DETAILED DESCRIPTION OF THE DRAWINGS

Figure 1:
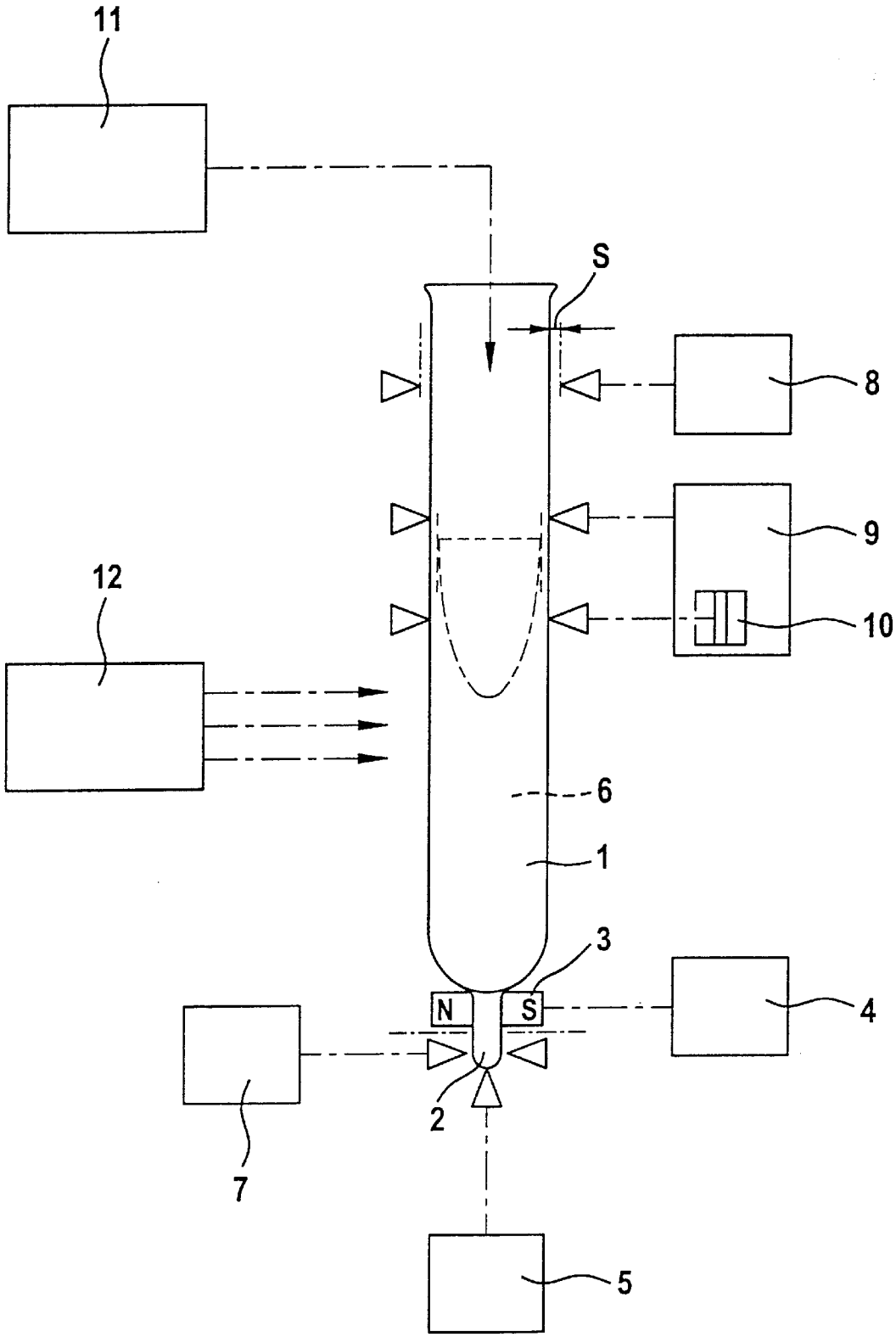
FIG. 1 shows a diagrammatic illustration of a stirring device of the type specified here.

The stirring device shown in FIG. 1 contains, a a vessel for receiving a pourable substance, generally a liquid, a test tube 1 which has, at its lower end, a pin-like integrally formed extension 2. Pushed onto this pin is a magnetic ring 3 which is magnetized on regions located diametrically opposite one another, in such a way that a magnetic-field generating system 4, which is indicated diagrammatically as a block symbol in FIG. 1 and which generates a rotating magnetic field, can come into interaction with the magnetic ring 3 magnetized in a way described and, together with the said magnetic ring, forms drive means which set the test tube 1 in rotation about its vertical longitudinal axis.

Vertical support means 5, for example in the form of a step bearing or bearing depression giving the pin 2 support, absorb the weight of the vessel and of a liquid filling 6 located in it. In addition, near the lower end of the pin 2 lower rotary mounting means 7 may be provided, which give the pin 2 and the lower end of the test tube 1 lateral support.

Upper rotary mounting means 8 for the lateral support and mounting of the upper test tube end are provided near the upper filling orifice of the test tube 1. These upper rotary mounting means are in the form of a bearing bore which is led through a plate and which with its wall surrounds the test tube outer wall with sufficiently large bearing play S, the plate provided with the bearing bore being supported on a frame, not shown in FIG. 1, which is itself supported against an appliance base, in which the magnetic-field generating system of the drive means can be accommodated.

It may be pointed out expressly, here, that, in practical embodiments, it is possible to accommodate in the appliance base a multiplicity of magnetic-field generating systems, the rotating magnetic fields of which are in each case suitable for driving in rotation a corresponding multiplicity of test tubes or similar vessels which are mounted in a common frame provided with bearing bores.

The stirring device specified here contains, in addition, centring and stabilizing means 9 which ensure largely low-friction vibration-free running of the test tube 1 within the play s of the upper rotary mounting means and, if appropriate, also of the lower rotary mounting means.

The centring and stabilizing means contain, in the embodiment according to FIG. 1, a damping device 10 which immediately damps any excited vibrations or rattling phenomena within the play S during the rotation of the test tube 1.

Furthermore, the stirring device according to FIG. 1 contains a treatment device 11 for influencing the space within the test tube 1 and a further treatment device 12 for influencing the liquid filling 6 through the wall of the test tube 1 from outside. The treatment device 11 may be placed in the form of an insert onto the filling orifice of the test tube 1 and rotate with the latter. Despite the centre of gravity of the rotating part of the device being displaced upwards as a result, vibration-free and concussion-free running of the rotating part is ensured by the centring and stabilizing means 9.

The further treatment device 12 is a device fixed to the frame, for example a microwave source, an induction heating, a heating device and the like, which, in a wall region of the test tube 1 not covered by the rotary mounting means and the centring and stabilizing means, acts contactlessly on the said test tube and on its filling.

Instead of the test tube 1, a metallic vessel or a plastic vessel may also be used, in which case wall material where loss is involved allows the use of, for example, induction heating.

Whilst FIG. 1 shows a stirring device of the type specified here in a very general form, FIGS. 2 to 6 show practical embodiments of the upper rotary mounting means for positioning and guiding the vessel, the centring and stabilizing means being integrated into this upper rotary mounting in these embodiments.

Figure 2:
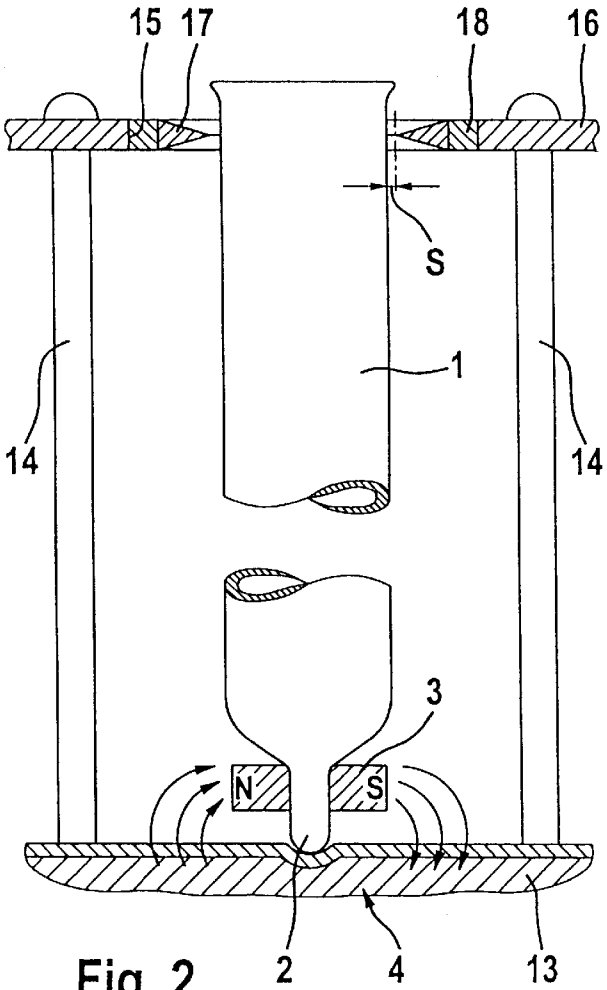
FIG. 2 shows a partially sectional side view of a practical embodiment of a stirring device, with the drive means indicated diagrammatically.

In the embodiment according to FIG. 2, a plate 16 provided with bores 15 is supported by means of a frame 14 via an appliance base 13 which contains magnetic-field generating systems 4 interacting with the magnet 3. The bores 15 have a considerably larger diameter than the outside diameter of the vessels or of the test tubes 1. Within these bores 15 are held tetrafluoroethylene rings 17 of wedge-shaped ring cross section, which with their inner edge, which is designed in the manner of a knife edge, maintain a very slight play S with respect to the outer wall of the vessels 1. Between the tetrafluoroethylene rings 17 and the bores 15 of the plate 16 are allocated damping rings 18 made of resilient material, for example plastic foam or plastic of very soft quality. The tetrafluoroethylene rings 17 form, with the damping rings 18, both the upper rotary mounting means and the centring and stabilizing means for mounting the vessels or test tubes 1 in a vibration-free manner, without being inclined to rattling, in their region near the filling orifice, whilst, at the lower vessel end, the pins 2 engaging in step bearings constitute an accurate and play-free rotary mounting and, at the same time, form the vertical support means for absorbing the vessel weight and the filling weight.

Figure 3:
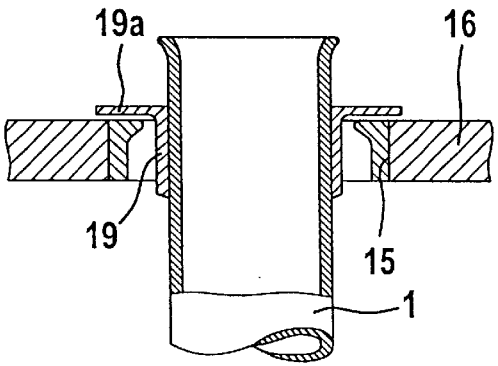

The embodiment according to FIG. 3 provides, near the filling orifice of the vessels or test tubes 1, plastic rings 19 which are pushed onto these from below and are adapted to the outer circumference of the vessels and which possess a radial flange l9*a* which has an upper comparatively large diameter and which covers the respective bore 15 of the plate 16 and rests loosely on the upper end face of a plastic ring inserted into the bore 15. The plastic ring may be provided with a radial flange which is directed towards the mid-axis of the vessel 1 and which maintains sufficient play with respect to the cylindrical outer face of the plastic ring 19. When the vessel 1 is set in rotation and begins to wobble, the sliding friction between the radial flange 19*a* and the plastic ring 19 and the upward-pointing faces of the plate 16 and/or of the ring inserted in the bores 15 of the latter effectively damps wobbling movements and vibrations of the vessel 1, so that the vessel resumes centric running.

This principle of centring and stabilizing means, which is shown in FIG. 3, may also be applied to regions near the lower vessel end and is distinguished by particular simplicity.

Figure 4:
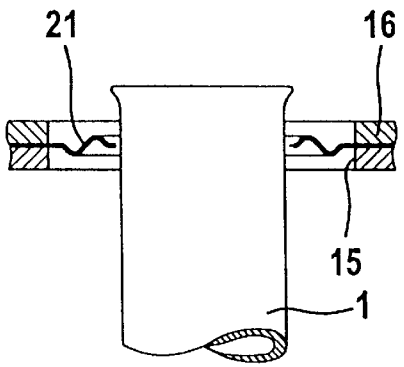
FIGS. 3 to 6 show in each case the upper part of a vessel, of the associated rotary mounting means and of the centring and stabilizing means in embodiments modified with respect to FIG. 2.

The plate 16 of the embodiment according to FIG. 4 is composed of two parts, between which diaphragm-like annular discs 21 are clamped in the region of the bores 15. The radially inner edge of the diaphragm discs 21 is of a slight distance from the outer wall of the vessel or test tube 1 and the corrugations of the annular cross section result in elastic resilience of the inner edge of the diaphragm discs 21 with respect to vibrations and impacts which may be induced during the rotation of the vessel or test tube 1, the annular disc 21 absorbing and damping impact energy and vibration energy. In the stirring device according to FIG. 4, too, the annular discs 21 clamped between the parts of the plate 16 therefore form both the upper rotary mounting means and centring and stabilizing means for rattle-free and vibration-free rotation of the vessels 1 within a wide rotational speed range.

Figure 5:
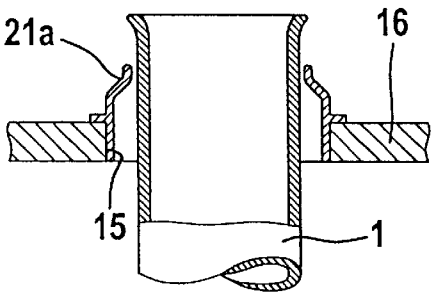

The embodiment according to FIG. 5 contains as centring and stabilizing means, in the region of the upper end of the vessel 1, a ring inserted into the bores 15 of the plate 16 and having a collar supported against the upper edge of the bore 15 and elastically resilient fingers 21*a* which point upwards from the said collar and which, in a similar way to the annular disc 21 of the embodiment according to FIG. 4. absorb and damp impact energy and vibration energy when the vessel 1 begins to experience wobbling movements during its rotation, but, when the vessel 1 is running centrically, remain essentially out of contact with the outer wall of the vessel 1.

Figure 6:
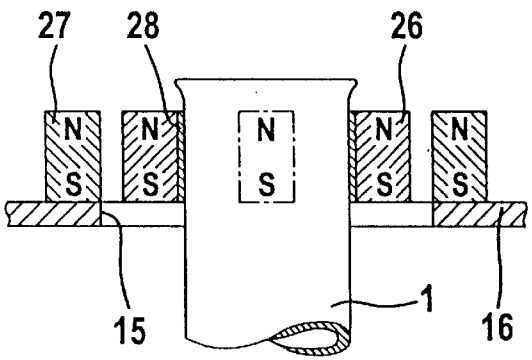

FIG. 6 shows rotary mounting means provided in the region of the upper end of the vessel 1 and also centring and stabilizing means in the form of a magnetic ring 26 pushed onto the vessel, on the one hand, and of magnetic rollers or magnetic discs 27 arranged at an equal circumferential interval along the edge of the bore 15 of the plate 16, on the other hand. The magnetic ring 26, which can be pushed onto the vessel 1 from below, with a resilient plastic ring 28 interposed, possesses by virtue of appropriate magnetization, for example on the side of the upper annular face, a north pole, and, on the lower annular face, a south pole. The magnetic rollers or magnetic discs 21 likewise possess the north pole on their upper end faces and the south pole on their lower end faces, so that, as a result of the repulsion of like poles, the interspace between the magnetic ring 26 and the magnetic rollers or magnetic discs 27 is maintained It may be noted, here, that all the vessels 1 may have a shape differing from the elongated cylindrical shape, and that the vessels may have a neck part of reduced circumference in the region near the filling orifice. According to an expedient form of the vessels 1, these may be provided, near the filling orifice, with an all-round wedge-shaped wall contraction which performs a double function. On the one hand, this contraction, in its region, reduces the effective vessel circumference and forms the preferred point or engagement of the rotary mounting means and centring and stabilizing means, and, in this case, a greatly reduced tendency to vibrations and rattling phenomena can be observed. On the other hand, however, the wall contraction constitutes, with respect to the vessel interior, a bead which runs all-round on the inner wall of the vessel near the upper end of the latter and which prevents the liquid, rising on the vessel inner wall as a result of the centrifugal forces during the rapid rotation of the vessel, from reaching the filling orifice and being thrown out of the vessel. If vessels with a wall contraction of this kind are used, for example in stirring devices according to FIG. 4, the radially inner edge of the diaphragm discs 21 is not designed continuously, but is interrupted by cutouts, so that fingers located between the cutouts reach radially inwards from the radially outer edge of the diaphragm discs 21. These diaphragm disc fingers make it possible to push in the vessels, the diaphragm fingers being bent out elastically and finally snapping into the wall contraction at the latter, in such a way that the radially inner ends of the diaphragm fingers then bear with slight play on the bottom of the wall contraction and bring about the upper rotary mounting means and the centring and stabilizing means in the way described.

It may be remembered that FIGS. 2, 4 and 6 each show only a single vessel, but that, in practical stirring devices of the type specified here, the appliance base may be equipped with a multiplicity of magnetic-field generating systems, via which a corresponding multiplicity of vessels 1 are then supported and rotatably mounted via a frame 14.

An explanation will be given, then, for the tendency of an upper rotary mounting to rattle in stirring devices of a known type, in which the upper rotary mounting has no centring and stabilizing means and rigid materials are located opposite one another across the play S between the wall of the bore 15 and the outer wall of the vessel 1.

Should frictional contact between the vessel outer wall and the inner wall of the bore 15 (FIG. 2) occur due to an unbalance of the filling of the vessel 1 during the rotation of the latter, the braking of the vessel outer wall at the point of contact results, when the vessel 1 rotates, in the said vessel beginning to roll on the bore wall, with the consequence that the axis of rotation of the vessel 1 is deflected about the support point located at the lower end of the vessel 1. However, the centrifugal forces take effect at an angle of 90° to the direction of deflection. These forces disastrously intensify the pressure force at the point of contact and therefore also the urge of the upper part of the vessel 1 to roll on the inner wall of the bore 15. A rapid build-up of the rattling effect therefore occurs, this effect being prevented by centring and stabilizing means of the type specified here.

Another possibility, not illustrated in the drawing, for attenuating the rattling effect is to provide upper rotary mounting means in the form of bearing tenons which project in each case into the mouth of the vessel 1 and which may be anchored on a plate. These bearing tenons are provided at their lower end with a circumferential bead, an annular face of maximum diameter of which is at a slight distance from the inner wall of the upper part of the vessel 1. If contact between the circumferential bead of the bearing tenon, on the one hand, and the vessel inner wall, on the other hand, occurs due to an unbalance of the filling of the vessel 1, the same deflections of the axis of rotation of the vessel 1 and the same centrifugal forces as described previously occur during the rotation of the vessel 1. Here, however, the said centrifugal forces do not bring about an intensification of the pressure force, but cause the inner wall of the vessel 1 to be lifted off from the circumferential bead of the bearing tenon. Such a rotary mounting of a stirring device of the type proposed here thus at the same time forms centring and stabilizing means for a rattle-free upper mounting of the vessel 1.

In an application, likewise not shown, of the principle just explained, there is provision for vessels 1 which, at their upper filling orifice, have a folded-round rim, under which engages a tubular extension which projects upwards from the edge of the bore 15 of the plate 16 (FIG. 2). When the outer face of the tubular extension contacts with the inner face of the folded-round rim, centrifugal forces occur on the outer face of the tubular extension and bring the said faces out of contact again.

The principal described previously may be applied to the lower mounting means of a vessel by pushing onto the lower vessel end a cylindrical sleeve, into which extends from the appliance bane a bearing tenon which is fastened to the latter and which is provided with an upper circumferential bead. This circumferential bead interacts with the inner wall of the sleeve in a way corresponding entirely to that described above in respect of the upper rotary mounting.

In addition, the upper end face of the bearing tenon may also form the vertical support means for absorbing the weight of the vessel 1 and of its filling.

Figure 7:
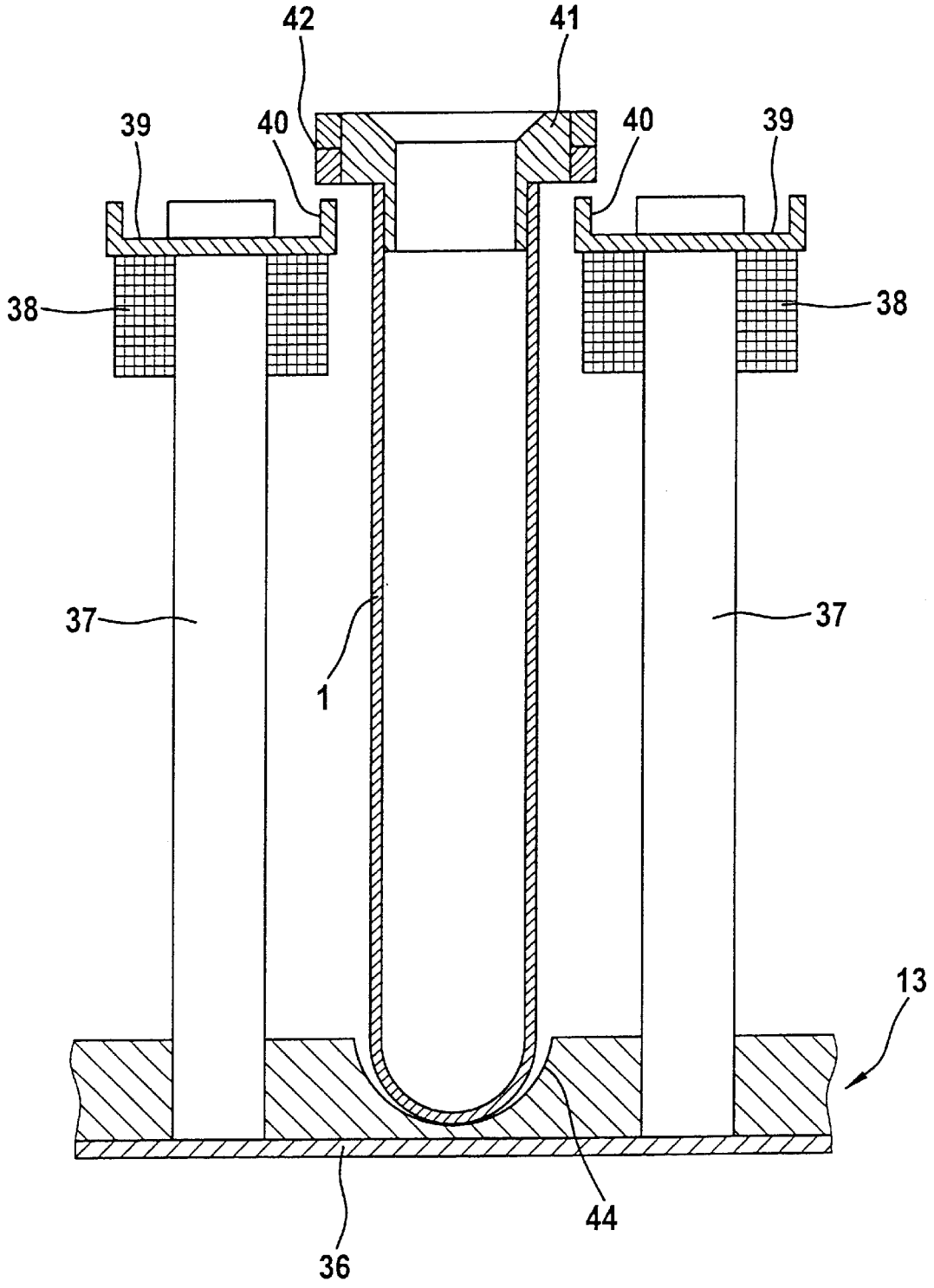
FIG. 7 shows a sectional side view of a modified embodiment of a stirring device of the type specified here, with a drive provided near the upper vessel and and supported against the appliance base.
Figure 9:
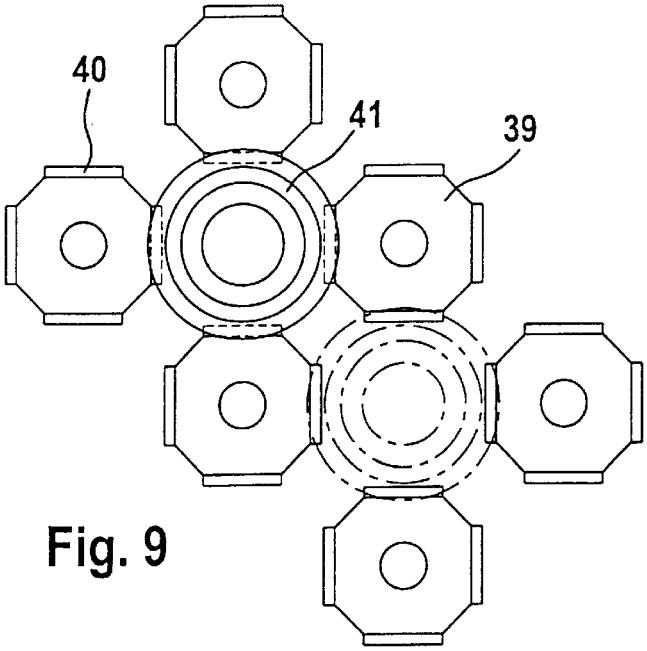
FIG. 9 shows a top view of the pole-shoe arrangement of the electromagnetic drive of the device according to FIG. 8.

Whereas, in the embodiments described hitherto, the drive for the vessels 1 was provided near their lower end, in the embodiment according to FIG. 7 this drive is provided in the region of the filling orifice of the vessels 1. The magnetic-field generating system contains a yoke plate 36 forming part of the appliance base 13, cores 37 which project upwards from the said yoke plate, exciting coils 38 provided at the upper ends of the said cores, and, finally, pole plates 39 fastened to the upper ends of the cores 37 and having pole shoes 40 bent vertically upwards. The shape of the pole plates 39 can be seen, for example, from FIG. 9.

Figure 10:
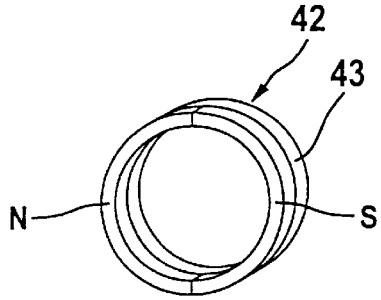
FIG. 10 shows as perspective view of a magnetic ring which is located in a plug placed onto the vessel mouth and which interacts with the pole shoes.

Inserted into the filling orifice of the vessels 1 is a lid part 41 which is provided with an access orifice and in the flange of which a magnetic ring 42 is embedded. FIG. 10 reveals the shape of this magnetic ring. Its downward-pointing and face possesses a south pole in one half and a north pole in the other half. That part of the magnetic ring which is upper in the position of use and which is designated by 43 in FIG. 10 forms a magnetic yoke. The magnetic ring 42 has a diameter such that its lower end face is approximately in alignment with the pole shoes 40 of the pole plates 39 in the vertical direction.

During operation, when the coils 38, four of which are arranged around the vessel 1, are excited, the magnetic ring 42 is drawn onto the pole shoes 40 and, moreover, set in rotation by the magnetic rotary field prevailing between the pole shoes 40, so that the lid part 41 and the vessel 1 rotate. The attraction of the magnetic ring 42 in the direction of the pole shoes 40 causes the vessel 1 to be pressed with its lower approximately hemispherical end into a corresponding bearing trough 44 at the appliance base.

If an unbalance seeking to pivot the longitudinal axis of the vessel about the point of contact between the vessel and the trough 44 occurs in the vessel 1, the end faces of the pole shoes 40, on the one hand, and the lower end face of the magnetic ring 42, on the other hand, move away from one another in the lateral direction, the force of attraction between the said parts drawing the vessel 1 and the lid part 41 back again into the symmetrical position shown in FIG. 7.

Figure 8:
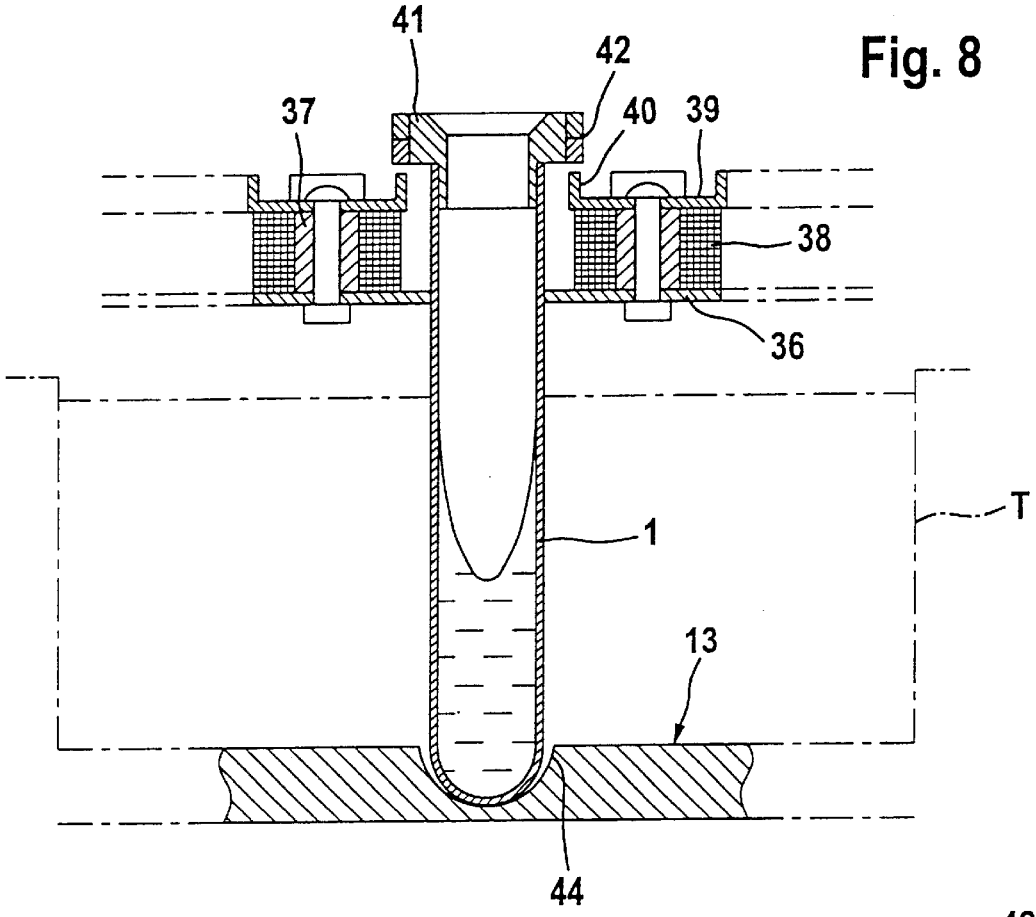
FIG. 8 shows a sectional view of an embodiment modified with respect to FIG. 7, with drive means which are located near the upper vessel end and which is held independently of the appliance base.

FIG. 8 shows an embodiment, modified with respect to FIG. 7, of a stirring device of the type specified here, in which the cores of the magnetic-field generating system are not connected to the appliance base 13, but project upwards from a yoke plate 36 which has bores for the passage of the vessels 1 and which is provided at a relatively short distance beneath the pole plates 39, in such a way that the exciting windings 38, the cores 37, the yoke plate 36 and the pole plates 39 constitute a plate-like structure which is located at the level of the upper part of the vessels 1 and which can be lifted off, together with the vessels 1, from the appliance base 13. A frame for supporting the magnetic-field generating system or magnetic-field generating systems during operation at a suitable distance from the lower end face of the magnetic rings 42 is omitted in FIG. 8 in order to simplify the illustration, but is, of course, provided in a practical embodiment.

The embodiment according to FIG. 6 is suitable particularly for stirring devices of the type specified here, in which the vessels are to be held in a cooling bath or in a heating bath during the stirring treatment of their liquid filling. For this purpose, a liquid tank T, indicated in FIG. 8 by dot-and-dash lines, is located above the appliance base and below the plate-like structure containing the upper rotary mounting means and the centring and stabilizing means.

Figure 11:
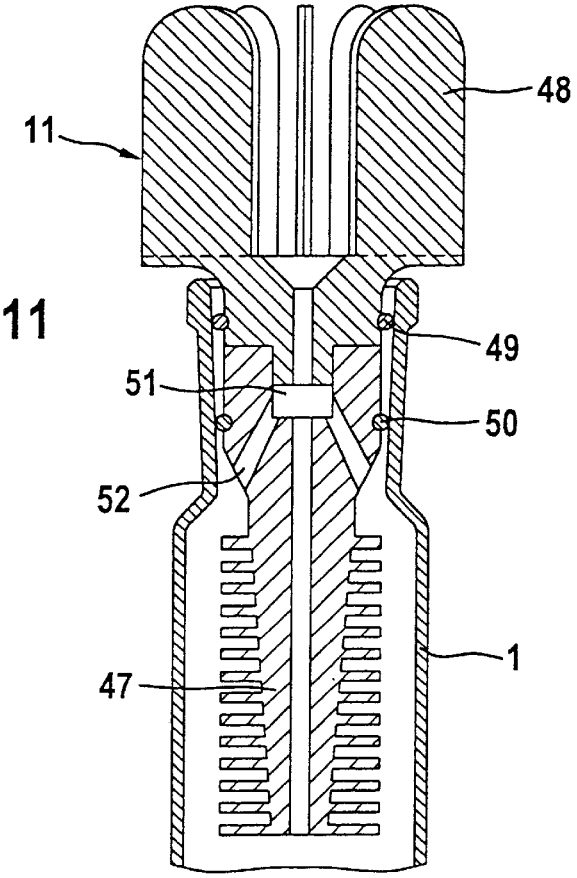
FIG. 11 shows a sectional view of the upper part of a vessel, such as is used, for example, in devices according to FIGS. 2 to 6, with an inserted cooler.

FIG. 11 shows a treatment device 11 in the form of a cooling head inserted into the mouth of a vessel 1 which may be an integral part of a stirring device, for example according to one of FIGS. 1 to 6. The cooling head contains a heat-exchange body 47 manufactured from material of good thermal conductivity and provided with ribs and a fan wheel 48 which is screwed to the said heat-exchange body and is located above the access orifice of the vessel 1 and which has, in horizontal section, the shape apparent from FIG. 12. The fan wheel 48, too, consists of material of good thermal conductivity. The hub of the fan wheel 48 and the connecting extension of the heat-exchange body 47 are supported on the inner wall of the neck of the vessel 1 in each case via sealing rings 49 and 50. A central axial-bore extends through the heat-exchange body 47 and through the hub of the fan wheel 48. Between the hub of the fan wheel and the heat-exchange body 47 is provided a chamber 51 which serves as a bubble and condensate trap and which is connected to the interior of the vessel 1 via downwardly and upwardly running ducts 52 of the heat-exchange body. During the rotation of the vessel 1 and of the cooling head, the vanes 53 of the fan wheel 48 convey cooling air radially outwards and cause heat to be transported away from the heat-exchange body 47. The vacuum occurring in the radially inner region of the fan wheel can suck condensate, via the axial duct of the cooling body, into the chamber 51. There, however, the condensate is thrown radially outwards and passes via the ducts 52 back into the interior of the vessel 1.

Figure 12:
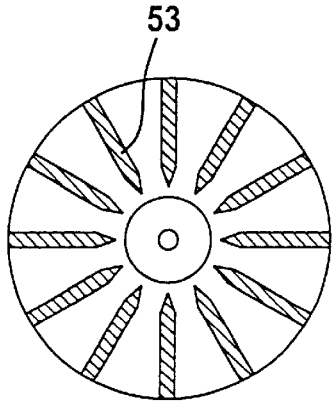
FIG. 12 shows a horizontal section through the coolant head which is designed as a fan wheel.

The centring and stabilization of the mounting of the vessels 1, said centring and stabilization being provided in a stirring device of the type specified here, makes it possible to attach treatment devices 11 in the manner of the cooling head according to FIGS. 11 and 12, the centre of gravity of the rotating device parts being relatively high. The device nevertheless runs very smoothly over a wide rotational speed range.

Figure 13:
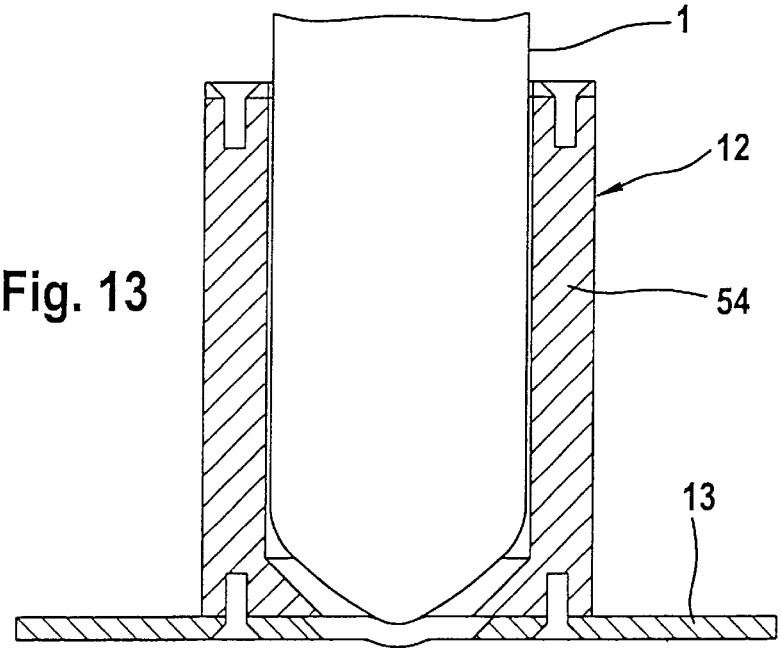
FIG. 13 shows a section through the lower part of a stirring device of the type specified here, with a heater surrounding the lower vessel end.

FIG. 13 shows an example of e further treatment device 12 in the form of a heater 54 surrounding the lower part of the vessel 1. The heater is fastened in the form of a cylindrical casing on the top side of the appliance base 13. By virtue of the good centring and stabilization of the rotary mounting of the vessels 1, the heater 54 can surround the outer face of the vessel 1 at only a slight distance and therefore displays increased efficiency during the treatment of the vessel content.

If a cooling head of the type shown in FIG. 11 is used in conjunction with a further treatment device in the form of a heater according to FIG. 13, a liquid to be treated in the vessel 1 is evaporated in the lower region of the latter and is condensed again in the upper region at the heat-exchange body 47, in such a way that, within the vessel, circulation in the vertical direction occurs in addition to the stirring effects caused by the rotation of the vessel.

It may be noted, here, that, in all the embodiments shown, the change in direction of rotation and the change in rotational speed are important for influencing the mixing result of stirring devices of the type specified here. For this reason, the action of treatment devices 11 should be independent of the direction of rotation.

Figure 14:
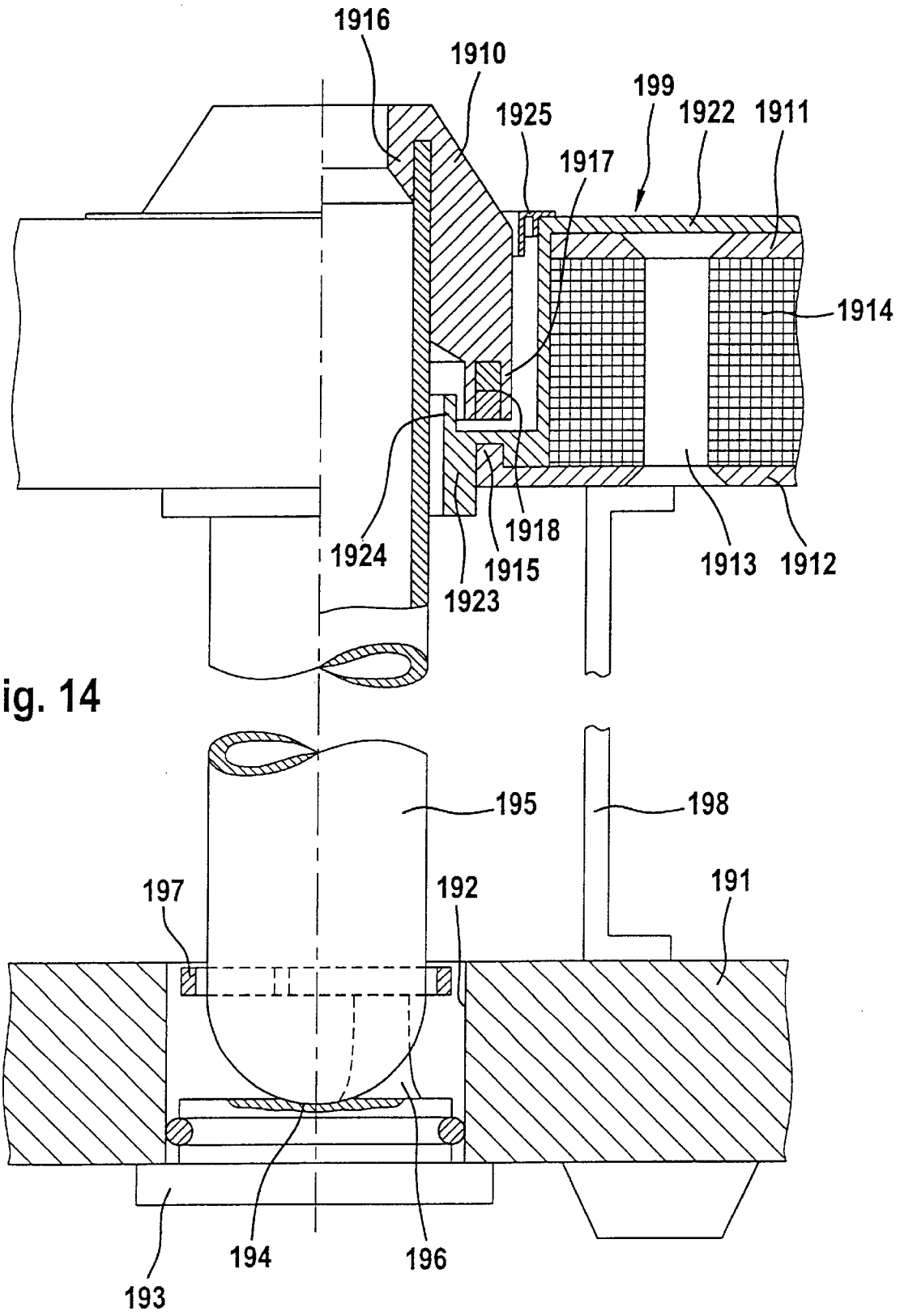
FIG. 14 shows a partially sectionally depicted stirring device in a development of the embodiment according to FIG. 8, with mechanical centring and stabilizing means at the lower vessel end and with both mechanical and magnetic centring and stabilizing means near the upper end of the vessel.

The stirring device according to FIG. 14 has a baseplate 191 which is provided with cylindrical perforations 192. A plug 193 is inserted from below into each perforation 192, the said plug being provided, on its upward-pointing face, with a shallow bearing shell 194 which, together with the spherical lower end of the vessel 195, forms vertical support means for a liquid to be treated and exerts low centring forces on the lower end of the vessel 195.

An individual elastic web 196 projects upwards from the plug 193 to a slotted ring 197 which surrounds the vessel wall in the already essentially cylindrical region of the latter and which serves for returning the vessel into the centric position again gently and in a vibration-damping manner if the vessel 195 runs onto the said ring in the event of vibrations and rattling phenomena of the vertical support means. It is clear, surprisingly, that, even at high rotational speeds of the vessel of up to and above 8,000 l/min, the centring and stabilizing means in the form of the slotted ring 197, which is held via the plug 193 by means of the individual web 196 and which, like the said web and the plug, may be manufactured from viscoplastic, hold the lower vessel end centrically and, when the rotational speed is increased, allow the possibility of passing without difficulty through resonant ranges in which vibrations may occur.

Held above the baseplate 191 by means of frame parts or supports 198, indicated diagrammatically, is a plate arrangement 199 which contains an upper ferromagnetic yoke plate 1911 provided in each case with a perforation for the passage of the vessel 195 and of a lid 1910 placed on the latter, a lower pole-shoe arrangement 1912, pole shoes grouped around the respective perforation, pole cores 1913 extending between the yoke plate 1911 and the pole-shoe arrangement 1912, and exciting coils 1914 in each case surrounding the said pole cores. The exciting coils 1914 are excited by an electrical control device, not shown in the drawing, in such a way that a magnetic rotary field is formed via the upwardly bent pole pieces of the lower pole-shoe arrangement 1912 which are grouped around the perforations of the plate arrangement 199.

The lid 1910 placed onto the upper vessel end reaches with a tubular extension 1916 into the mouth of the vessel 195, the tubular extension 1916 being bevelled at the lower end towards the wall of the vessel 195 and forming a partial closure of the upper vessel mouth, in that the liquid filling pressed upwards by the centrifugal forces at a high rotational speed of the vessel 195 is held back in the vessel and is not thrown out of the orifice mouth.

On the outside, the lid 1910 extends axially downwards along the vessel wall and is provided at its lower edge with a flange 1917 which is spaced from the vessel wall and into which a magnetic system ring 1918 is embedded. The design of the magnetic system ring 1918 is as explained above with reference to FIG. 10. It contains an upper yoke ring made of ferromagnetic material and ferrite magnets in the form of a sector of an annulus which are attached axially to the said yoke ring from below and which are polarized axially.

The magnetic system ring 1918 draws the arrangement consisting of the vessel 195 and of the lid 1910 in the direction of the pole pieces 1915 which in each case are in the form of a sector of an annulus and which surround the respective perforation of the plate arrangement 199. The said ring thereby keeps the lower end of the vessel 195 pressed against the shallow step bearing 194 and at the same time exerts a centring effect on the upper vessel end, since any deviation of the longitudinal axis of the vessel from the vertical position causes the end face of the ferrite magnets to move an arc of a circle around the point of contact of the lower vessel end on the step bearing 194 and, at the same time, to move away from the end faces of the pole pieces 1915, thus leading to corresponding straightening forces restoring the vertical position of the vessel 195. When a rapidly rotating magnetic rotary field is generated, the magnetic system ring 1918 is driven by this rotary field and thereby sets the vessel 195 and the lid 1910 in corresponding rotation.

Each of the perforations of the plate arrangement 199 is provided with a lining 1923 which is affixed integrally to an upper plastic covering 1922 of the plate arrangement and which, together with the covering 1922, protects the drive means located in the plate arrangement 199 against environmental influences. A circumferential flange 1924 projects upwards from the lining 1923 spaced sufficiently from the vessel 195 and the faces of the lid 1910, the said circumferential flange interacting with the inner face of the flange 1917 of the lid 1910 as an emergency bearing and additional centring means, and, if the rotating flange 1917 runs with its inner face against the outer face of the flange 1924 and the parts just mentioned begin to roll on one another in the event of rattling phenomena, in conjunction with centrifugal forces of the structural unit formed from the vessel 195 and the lid 1910, the result of this is that the flange 1924 and the flange 1917 come out of contact again and rattling phenomena are damped.

Further centring and stabilizing means are provided, at the respective upper mouth of the perforation of the plate arrangement 199, in the form of a resilient plastic ring 1925 which is inserted into the upper mouth of the lining 1923 and, when the lid 1910 and the upper vessel end begin to rotate eccentrically, restores the centric position by means of a damping inner flange.

If, in a modification of the embodiment of FIG. 14, the rotary drive for the vessel 195 and the lid 1910 is not achieved by means of a magnetic-field generating system located near the upper vessel end, but, for example, by drive means located near the lower vessel end, magnetic centring and stabilizing means may nevertheless be provided, using the lid 1910 according to FIG. 14. In this case, instead of the pole pieces which are located around the respective perforation of a plate arrangement held via supports 198, a ferromagnetic counter-ring is embedded in the lower part, in such a way that the vessel and the lid, in turn, are always drawn towards the step bearing 194 by the magnetic system ring 1918 and the centring effect mentioned previously is achieved.

Figure 15:
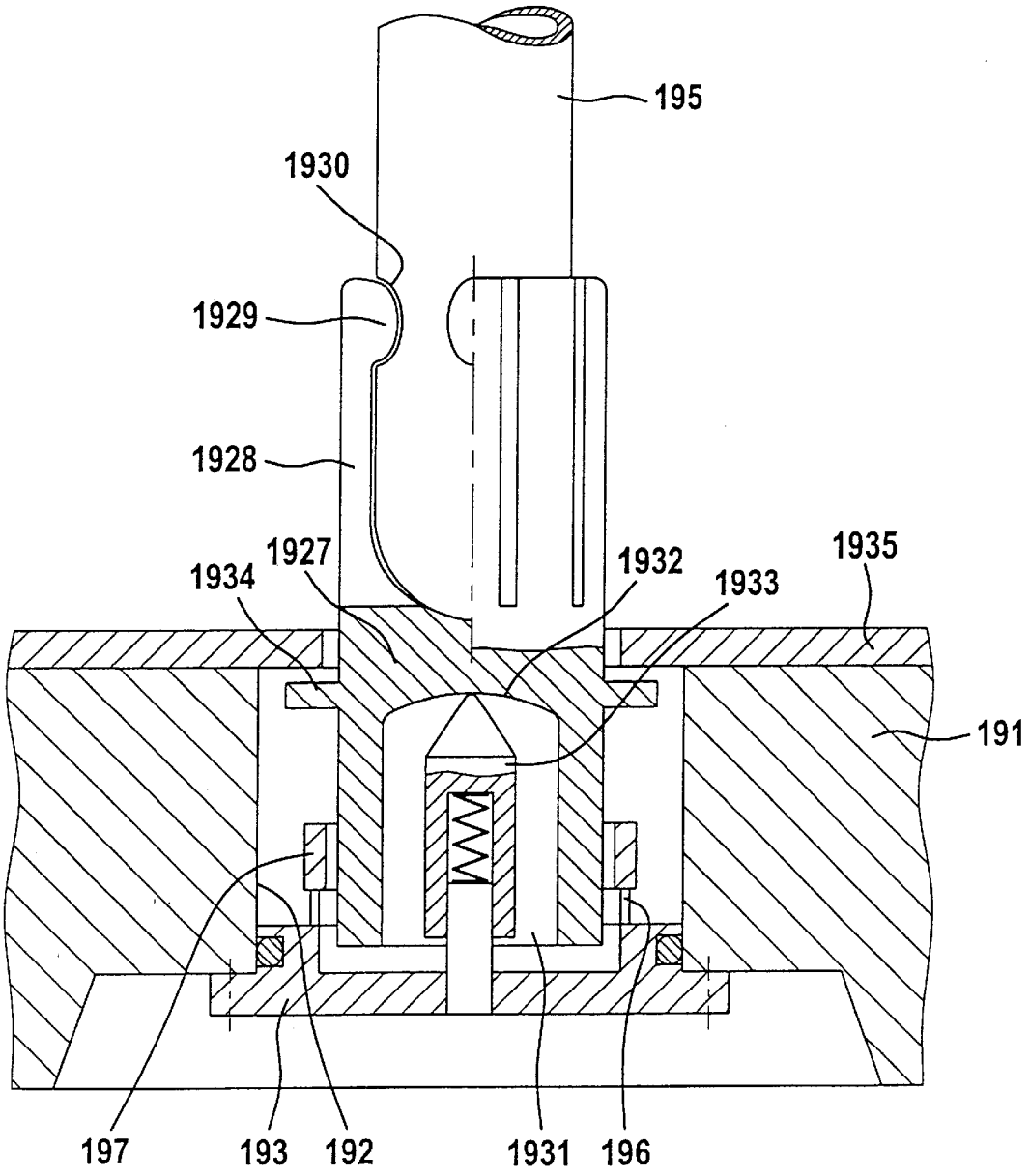
FIG. 15 shows a partially sectional view of the lower part of a further embodiment of a stirring device with a vessel capable of being pressed into a carrier.

In the embodiment of FIG. 15, the lower region of which is illustrated diagrammatically, the vertical support means and the rotary mounting means are formed on a carrier 1927 which, in an upper portion, has elastic fingers 1928 which surround a receiving space for receiving the lower end of the vessel 195 and which spring with catch projections 1929 into catch depressions 1930 when the vessel 195 is pressed into the carrier 1927. The catch depressions 1930 in the wall of the vessel 195 have the additional advantage that they bring about reinforced mechanical coupling between the vessel 195 and the liquid to be treated and, consequently, increased intermixing of the latter.

The carrier 1927 is provided, in its lower portion, with a bore 1931 which extends axially upwards and the upper termination of which in designed as a step bearing 1932. The curvature of the step bearing 1932 may be designed to be relatively low. Pressed springily against the step bearing 1932 in the way apparent from FIG. 15 is a bearing tenon 1933 which projects upwards concentrically in the perforation 192 of the baseplate 191 and, together with the step bearing 1932 of the carrier 1927, forms the vertical support means for the vessel 195 which may otherwise, at its upper end, be mounted, centred, vibration-damped and driven in the way apparent from FIG. 14.

In the embodiment according to FIG. 15, the perforation 192 of the baseplate 191 has inserted into it, in turn, as centring and stabilizing means a plug 193, via which a centring and damping ring 197 is held by means of elastically resilient webs 196, the said ring surrounding the cylindrical outer wall of the lower portion of the carrier 1927 with comparatively little play and returning the carrier 1927 and consequently the lower end of the vessel 195 into a centric position again when vibrations occur.

So as not to damage the bearing structure consisting of the bearing tenon 1933 and of the step bearing 1932 when the vessel is pressed into the space between the fingers 1928, care is taken to ensure that, during this operation, the bearing tenon 1933 moves back downwards until the lower end of the carrier 1927 runs against the plug 193 which may be fastened to the baseplate 191, after which, with the vessel 195 then moved in on the carrier 1927, the bearing tenon 1933 presses the entire arrangement up again into the position shown, for example, in FIG. 15.

When the vessel 195 is drawn away from the clamping hold between the fingers 1928, a radial flange 1934 of the carrier 1927 causes the carrier to be held back, and not separated from the baseplate 191, due to the running of the radial flange 1934 against a cover plate 1935 reaching over the mouth of the perforation 192 of the baseplate.

Figure 16:
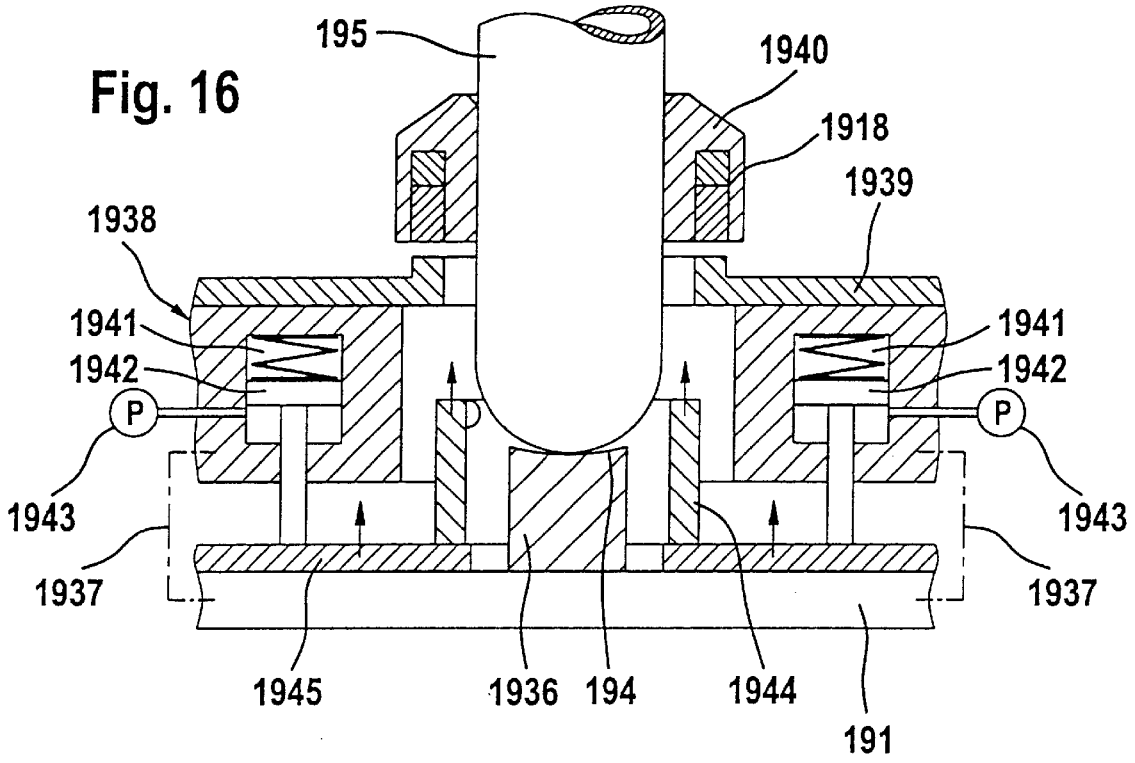
FIGS. 16 to 18 show diagrammatic sectional views of the lower part of modified embodiments with a magnetic rotary mounting and/or drive means at the lower vessel end or with a vessel capable of being pressed into a carrier in a similar way to the embodiment according to FIG. 15, the carrier having magnetic centring and stabilizing means which at the same time form the drive means.

The embodiment according to FIG. 16 contains as vertical support means, in a similar way to the embodiment according to FIG. 14, a shallow step bearing 194 which interacts as a mounting with the spherical lower end of the vessel 195 and is provided on an approximately cylindrical body 1936 projecting upwards from the baseplate 191.

As indicated diagrammatically by dot-and-dash lines 1937 in FIG. 16, the baseplate 191 has connected to it a structural unit 1938 which carries on its top side a yoke plate 1939 made of ferromagnetic material, which is provided in each case with a perforation for the passage of the lower end of the vessel 195 towards the step bearing 194. The perforation of the yoke plate 1939 has an all-round upward-pointing flange which is located opposite a magnetic system ring 1918 of the type described in connection with FIG. 14. This magnetic system ring 1918 is embedded into a ring 1940 made of viscoplaztic, which is pushed onto the lower end of the vessel 195. During operation, the vessel 195 is drawn downwards towards the step bearing 194 by the ring 1940 as a result of the interaction between the magnetic system ring 1918 and the circumferential flange of the ferromagnetic yoke plate 1939, the said circumferential flange acting as a ferromagnetic counter-ring, and, at the same time, the lower vessel end is centred as a result of the interaction between the magnetic system ring 1918 and the said part, serving as a ferromagnetic counter-ring, of the yoke plate 1939. It may be mentioned, here, that the rotary mounting, centring and stabilizing means provided at the upper end of the vessel 195 of the embodiment according to FIG. 16 have, on the frame side, a sufficiently large diameter of the respective perforations to make it possible to extract the vessel 195, together with the ring 1940, out of the stirring device.

The structural unit 1938 connected to the baseplate 191 contains, on the underside of the ferromagnetic yoke plate 1939, cylinders 1941 and pistons 1942 which are guided in the latter and which are capable of being subjected to pressure medium on the underside by means of pressure-medium sources 1943 and of being moved upwards counter to spring force, so that a plate 1945 provided in each, case with a cylindrical tube extension or distributing shutter 1944 can be lifted axially upwards and be lowered again when the pistons 1942 are relieved by the spring means.

The tube extension 1944 assigned in each case to a vessel 195 has a slightly larger diameter than the cylindrical part of the wall of the vessel 195, in such a way that, when the plate 1945 and the tube extension 1944 are in the lifted state, the inner wall of the latter, particularly when this inner wall is provided with a disturbing pump indicated in FIG. 16, induces the lower end of the vessel 195 to rattle, this being highly advantageous for carrying out particularly intensive mixing operations in the liquid to be treated in the vessel 195. The deliberate inducement of rattling phenomena for predetermined operating stages is of independent significance, irrespective of the rotational speed of the vessel 195. It may be pointed out expressly, here, that the mechanism for lifting the plate 1945 and the tube extension 1944 is described merely as an example and that many other mechanisms may be provided here for the random and reproducible triggering of rattling phenomena. It is essential that an annular body held relatively rigidly with respect to the frame is moved into a portion of the outer wall of the vessel 195 in which the annular body is only a slight radial distance from the vessel outer wall, so that, during operation, the latter comes essentially instantaneously into contact with the annular body and then triggers rattling movements which are undesirable in other operating modes and operating phases.

Figure 17:
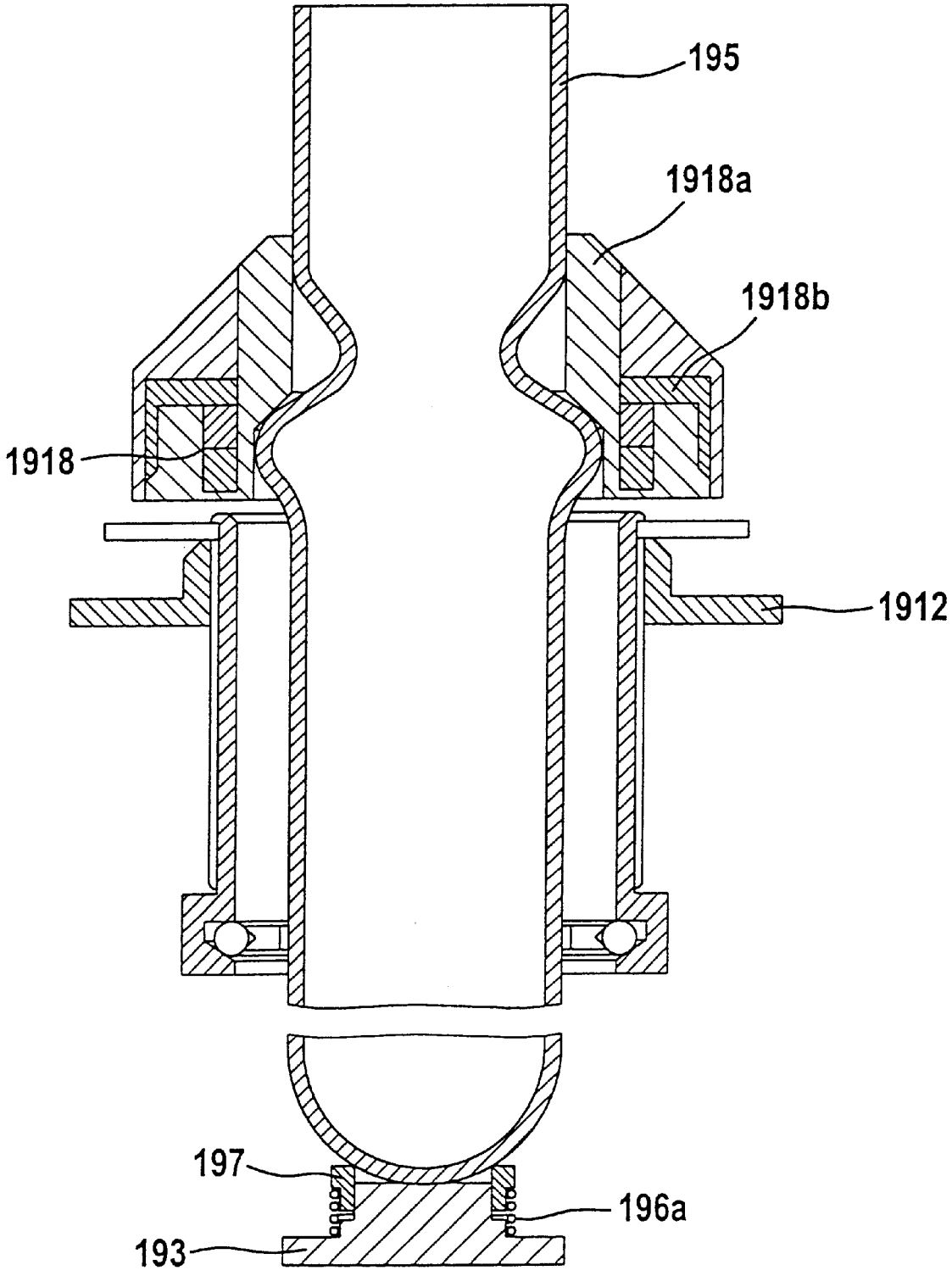

The embodiment according to FIG. 17 contains as vertical support means a plug or plinth 193 projecting upwards from a base not illustrated in FIG. 17 and having a plane surface, the lower cup-like end of the vessel 195 being seated on the said plug or plinth. For centring, there is a ring 197 which is guided vertically on the plug or plinth 193 and which is pressed with very little force against the lower vessel end by an encircling helical spring 196*a* and, during the rotation of the vessel, centres the latter and effectively damps vibrations. Near the upper end of the vessel 195, the latter is provided in a way illustrated with an all-round contraction which, as already mentioned previously, may serve as protection against an escape of liquid thrown up as a result of horizontal forces. Below the said contraction, the vessel 195 possesses an all-round bulge, so as to form a shoulder, against which is supported on annular body 1918*a* which is manufactured from plastic and which is pushed from above onto the mouth of the vessel 195 and contains a magnetic system ring 1918, the design of which was described previously, with reference to FIG. 10, as regards the magnetic system ring 42. A magnetic-field generating system which is located below the magnetic system ring 1918, and axially opposite the latter, in a plate-like arrangement fixed to the frame, the pole pieces 1912 being bent at their free ends in a similar way to what was described with regard to the embodiment according to FIG. 8. The perforation between the pole pieces and in a yoke plate belonging to the magnetic-field generating system is lined by a plastic sleeve which is pressed into an orifice in a plate covering the magnetic-field generating system and consisting of high-grade steel. The average person skilled in the art will readily recognize the relevant details from FIG. 17.

Of essential importance here, however, is a screening ring 1918*b* made of ferromagnetic material, which like the magnetic system ring 1918 is embedded in the annular body 1918*a* and which has the task of screening intensive stray fields, emanating from the magnetic system ring 1918, from adjacent vessels identical to the vessel 195 and of magnetic system rings, so that, in a matrix arrangement with magnetic-field generating systems and with vessels assigned to these, the said vessels do not influence one another and rotate reliably in synchronism with that magnetic rotary field which is excited by the magnetic-field generating system assigned to the respective vessel.

Figure 18:
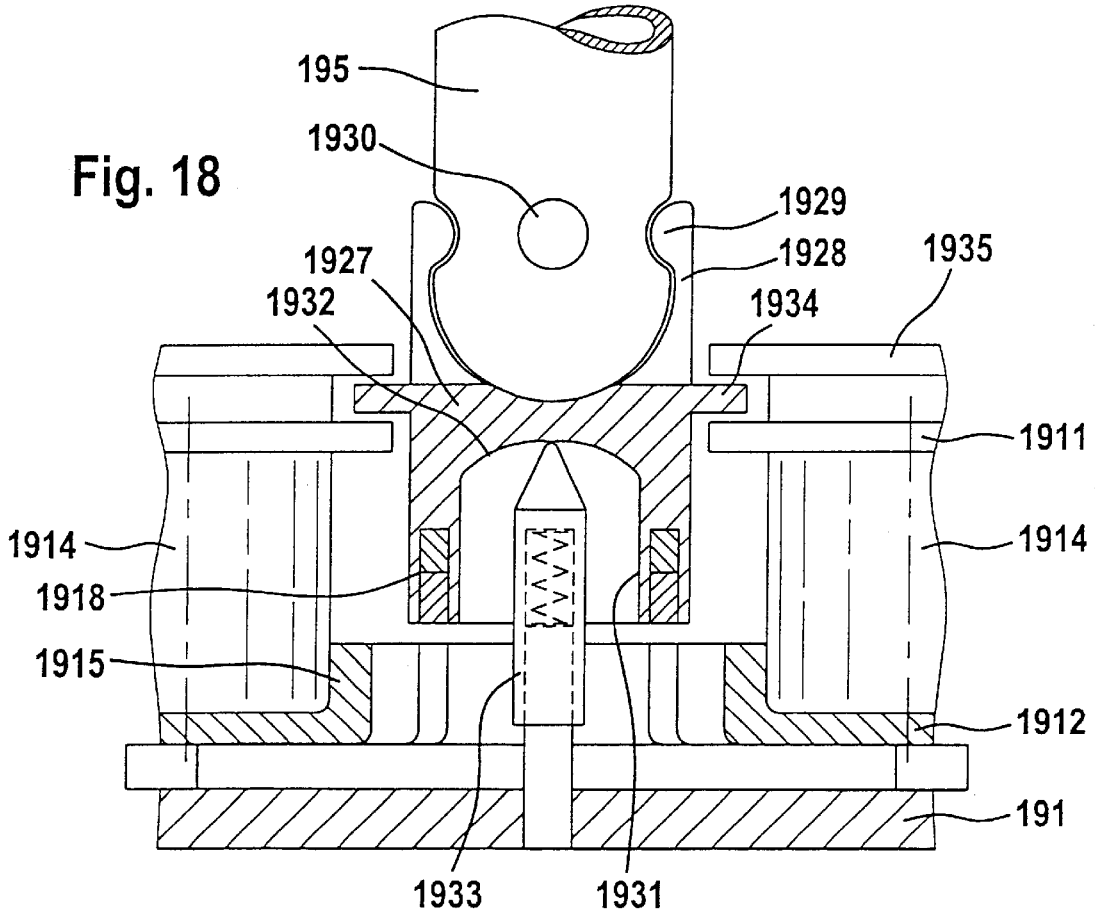

FIG. 18 shows an embodiment of the lower part of the stirring device of the type specified here, in which, in a similar way to the embodiment according to FIG. 15, a carrier 1927 consisting of viscoplastic is provided with fingers 1928 which in each case carry catch projections 1929 at the upper end and between which a vessel 195 provided with catch depressions 1930 can be locked with its lower end.

In this embodiment, drive means similar to those of FIG. 14 are provided in the region of the lower end of the vessel 195 here. In particular, once again, a sprung bearing tenon 1933 projects axially upwards from the baseplate 191 into a bore 1931 in the lower portion of the carrier 1927, the bore 1931 being closed off by a step bearing 1932 interacting with the pivot point of the bearing tenon 1933.

At the lower end of that portion of the carrier 1927 which is provided with a bore 1931, a magnetic system ring 1918 is embedded into the carrier. Located opposite the lower end face of the magnetic system ring 1918 at a specific vertical distance from it, in a circular arrangement, are the pole pieces 1915, in the form of a sector of an annulus, of the pole shoes, of a magnetic-field generating system which, in order to generate a magnetic rotary field around the space occupied by the carrier 1927, the said rotary field being generated via the end faces of the pole pieces 1915, has exciting coils 1914 which surround pole cores arranged between the pole shoes 1912 and a ferromagnetic yoke plate 1911, in a similar way to what was described in connection with the embodiment according to FIG. 14, although, as already mentioned, in the embodiment according to FIG. 18 the drive system is installed near the lower end of the vessel 195 here.

What is notable in the embodiment according to FIG. 18 is that the annular arrangement of the end faces of the pole pieces 1915 have a larger diameter than the annular arrangement, located above it, of the end face of the magnetic system ring 1918, thereby ensuring that, whenever the carrier 1927 attempts to tilt about the point of contact between the bearing tenon 1933 and the step bearing 1932, for example with the vessel 195 separated, essential regions of the mutually opposite end faces of the magnetic system ring 1918, on the one hand, and of the pole-piece arrangement 1915, on the other hand, move away from one another and straightening forces thus occur which straighten the carrier 1927 again relative to the fixed structure above the base plate 191.

According to FIG. 18, the radial flange 1934 of the carrier 1927 interacts with the plate 1935 fixed to the frame and located above the yoke plates 1911, in the same way as was described with regard to the embodiment of FIG. 15. The same applies accordingly to the springy support of the bearing tenon 1933.

It may also be indicated here, without this being illustrated in the drawing, how heat can be delivered to the liquid to be treated in the respective vessel 5, when the stirring device specified here is operated in a vacuum chamber. On account of the essentially contactlessly operating rotary mounting, centring and stabilization of a stirring device of the type specified here, heat can be transported only by radiation and residual convection to the vessel containing the liquid to be treated.

Heat is transported from the baseplate, for example, by conduction into the bearing tenon and then by radiation and residual convection to the carrier and, finally, from the latter via the wall of the vessel into the liquid to be treated.

In another embodiment, the mutually opposite faces transmitting heat by radiation and residual convection are enlarged, on the side of the heated baseplate and on the side of the carrier, by mutually coaxial sleeve parts engaging one in the other in a comb-like manner in cross section.

This enlargement of faces may also be achieved by means of annular discs projecting radially from the carrier and fixed annular discs which project correspondingly radially inwards and the latter being designed in a split arrangement for mounting purposes.

It may also be mentioned once again, here, that the specified design allows rotational speeds of the vessel of up to and above 8,000 l/min, such high rotational speeds leading to acceleration forces of more than 500 times gravitational acceleration which act on the liquid to be treated. These acceleration forces effectively prevent the formation of foam and appreciably influence the treatment result. It is important, furthermore, that the high rotational speeds of the vessel or vessels cause these, when supported at a point at their lower end or near their lower end, to behave in the same way as highly stable gyroscopes which are held in their stable vertical position, merely as a result of gentle correcting movements, by the centring and stabilizing means specified here, whilst vibrating movements which may possibly occur can be damped extremely quickly.

The invention also embraces embodiments of the type described, in which insert vessels for receiving the liquid to be treated are inserted into respective vessels, which may consist of plastic or glass or high-grade steel, in such a way that, in embodiments of this kind, the vessels 5 form a fixed integral part of the device.

Figure 19:
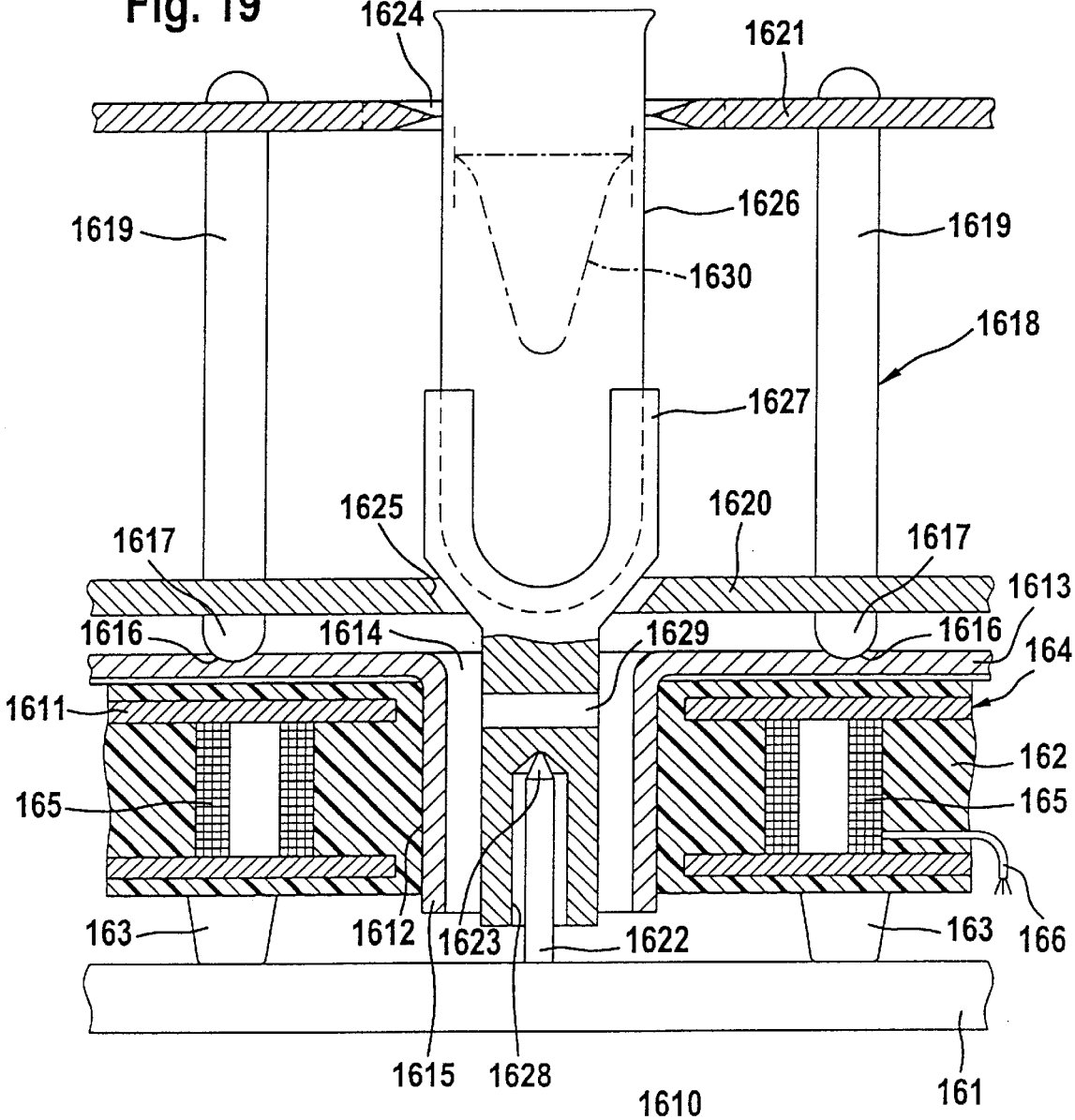
FIG. 19 shows a partially sectional side view of a preferred embodiment of a device for stirring or mixing or agitating liquids, of a type specified here.

The device shown in FIG. 19 contains a bottom plate 161, on which an appliance base is supported via feet 163.

Located in the appliance base 162 is a magnetic-field generating system 164, the exciting coils 165 of which are connected via a cable 166 to a control device, by means of which the exciting coils 165 can be supplied with electrical current in such a way that the magnetic-field generating system can generate, in a specific region of the appliance base 162, an intensive rotating magnetic driving field, the rotational speed and direction of rotation of which can be adjusted or varied randomly.

Figure 20:
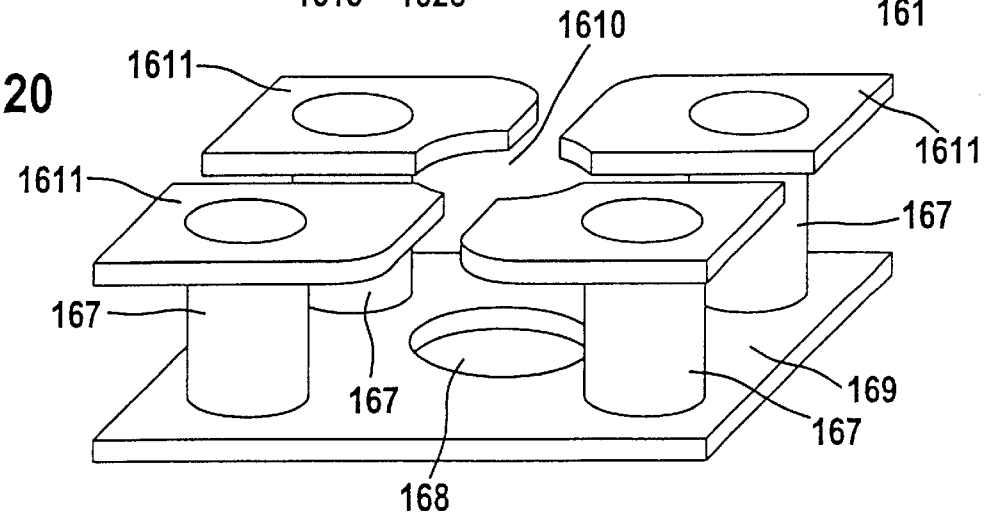
FIG. 20 shows a diagrammatic perspective view of the cores, pole shoes and magnetic returns of the magnetic-field generating system to a device according to FIG. 19.

The magnetic-field generating system 164 in moulded within the appliance base 162, for example in plastic, and contains the cores 16 surrounded by the exciting coils 165, a magnetic return plate 169 provided with a perforation 168 and also pole pieces 1611 fastened to the upper end of the cores 167 and grouped around a perforation 1610 vertically in alignment with the perforation 168, as may be seen in detail from FIG. 20.

A continuous perforation 1612 in the overall body of the appliance base 162 corresponds to the orifices or perforations 168 and 1610 of the magnetic-field generating system 164, the radially inner ends of the pole pieces 1611 being located near the upper mouth of the perforation 1612, within the plastic moulding compound behind the inner face of the perforation. The intensive rotating magnetic driving field is therefore generated precisely in this region of the perforation 1612.

It is also apparent from FIG. 19 that a cover plate 1613 is laid onto the appliance base 162, the said cover plate having an orifice 1614 which corresponds to the perforation 1612 and along the edge of which is affixed integrally a sleeve 1615 which extends downwards as a lining through the perforation 1612. The cover plate 1613 provided with the sleeve 1615 can be removed from the appliance base for cleaning purposes and protects the appliance base from being soiled by liquid dripping out of treatment vessels.

The cover plate 1613 is provided with depressions 1616, into which feet 1617 of a frame 1618 can be inserted for the accurate positioning of the latter. The frame 1618 contains plates 1620 and 1621 spaced from one another by supports 1619 and provided with perforations.

It may be mentioned, at this juncture, that, in a modification of the embodiment according to FIG. 19 which is not shown in the drawing, the frame 1618 may also be designed in such a way that the supports 1619 are not supported against the cover plate 1613 and the appliance base 162, but extend, with lengthened feet led past the appliance base 162, as far as the bottom plate 161. Such a modified embodiment may be advantageous particularly when the device as a whole is designed for the simultaneous handling of a multiplicity of treatment vessels in conjunction with an appliance base containing a multiple magnetic-field generating system.

A bearing pin 1622 having a bearing pivot point 1623 projects upwards from the bottom plate 161.

A structural unit consisting of an approximately cylindrical treatment vessel 1626 and of a holding extension 1627 connected to the said vessel is inserted into the arrangement described hitherto via the upper orifice 1624 of the plate 1621 and the orifice 1625 of the plate 1620 and, finally, through the orifice 1614 of the cover plate 1623 and the perforation 1612 of the appliance base 162. The holding extension 1627 has arms which extend upwards in the way apparent from FIG. 19 and which are profiled on their inside in such a way that they grip and support the treatment vessel 1626 securely. The holding arms of the holding extension 1627 can be pushed through cutouts of the orifice 1624 of the plate 1621, the said cutouts being indicated by means of dot-and-dashed lines.

A cylindrical lower part of the holding extension is provided with a blind bore 1628 which extends upwards from its lower end and the upper end of which forms a step bearing interacting with the bearing pivot point 1623 of the bearing pin 1622 and intended for the pivot point mounting of the structural unit consisting of the holding extension 1627 and of the treatment vessel 1626.

Moulded into the cylindrical part of the holding extension 1627 above the end of the blind bore 1628 is a magnetic rod 1629 which, when the arrangement is in the position of use shown in FIG. 19, is located at the level of the pole pieces 1611 within the appliance base 162 and which is therefore exposed to the most intensive part of the rotating magnetic driving field generated by the magnetic-field generating system 164.

The conical designed orifice 1625 of the plate 1620 surrounds a correspondingly conically designed portion of the holding extension 1627 with sufficient play, but is dimensioned in such a way that, when the frame 1618 is lifted off from the cover plate 1613, the treatment vessel 1626 and the holding extension 1627 are likewise lifted off from the appliance base 162 and the bearing pin 1622.

The orifice 1624 of the plate 1621 likewise has sufficient play with respect to the outer wall of the treatment vessel 1626, since, if there is a sufficient rotational speed of the treatment vessel and of its content, centrifugal forces support the structural unit consisting of the holding extension 1627 and of the treatment vessel 1626. It may be expedient for only circumferentially distributed short circumferential portions of the inner edge of the orifice 1624 to reach near to the wall of the treatment vessel 1626, in order to avoid rattling.

If the magnetic-field generating system 164 of the appliance base is controlled in such a way that the treatment vessel 1625, together with its liquid filling 1630, accelerates quickly from standstill to a rotational speed of, for example, 2,000 revolutions per minute, liquid layers adhere to the inner wall of the treatment vessel and shearing of the hollow-cylindrical liquid layers takes place in succession as far as the longitudinal mid-axis of the treatment vessel. If the rotating arrangement is then braked, the radially inner hollow-cylindrical liquid layers maintain their rotational speed, once reached, for longer, whilst the near-wall liquid layers are braked more quickly, so that, once again, shearing and therefore intermixing of the liquid filling of the treatment vessel take place.

Multiple, if appropriate periodic acceleration, braking and acceleration in the opposite direction of rotation achieve an intensive stirring or intermixing effect. This action may be further reinforced if the treatment vessel 1626 is provided with inner wall projections or axially running ribs or turned-in portions or with a cross section differing from the circular shape.

Figure 21:
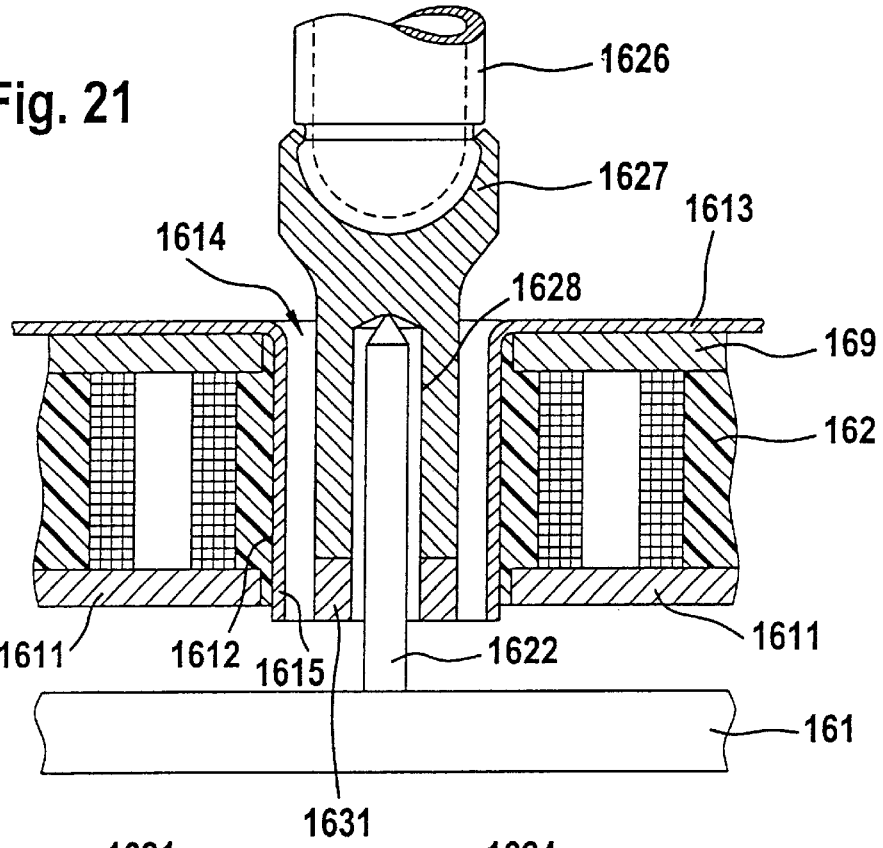
FIG. 21 shows a diagrammatic sectional side view of a further embodiment, modified with respect to FIG. 19, of a device of the type specified here.
Figure 21:
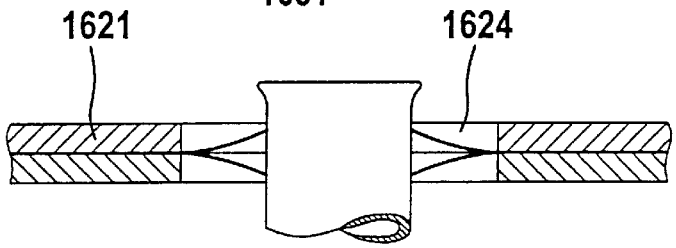

The embodiment of a device of the type specified here, which is indicated in FIG. 21 in its lower part only and diagrammatically, differs from that according to FIG. 19 essentially in that, within the appliance base 162, the magnetic-field generating system 164 is installed conversely to the embodiment according to FIG. 19, in such a way that the pole pieces 1611 are located on the underside of the appliance base 162 and the radially inner ends of the pole pieces are located opposite one another in the region of the lower orifice of the perforation 1612 of the appliance base.

The permanent-magnet body, which forms the driving part arrangement of the holding extension 1627, is therefore fastened to the lower end of the cylindrical portion of the holding extension 1627 and, here, is in the form of a diammetrically magnetized permanent-magnet ring 1631, the bore of which corresponds to the diameter of the blind bore 1628 extending upwards in the cylindrical portion of the holding extension. The mounting pin 1622 projecting upwards from the bottom plate 161 once again extends into the blind bore 1628 as far as the bore end serving as a step bearing, in a similar way to the embodiment according to FIG. 19.

Lateral arms integrally formed onto the holding extension 1627 in the upper part of the latter, by being snapped into a circumferential groove at the upper end of the treatment vessel 1626, make the connection with the treatment vessel, of which only the lower portion is shown in FIG. 21. In the device according to FIG. 21, too, a frame serving for the further support of the treatment vessel may be provided in the manner of the frame 1618 of the embodiment according to FIG. 19.

Figure 22:
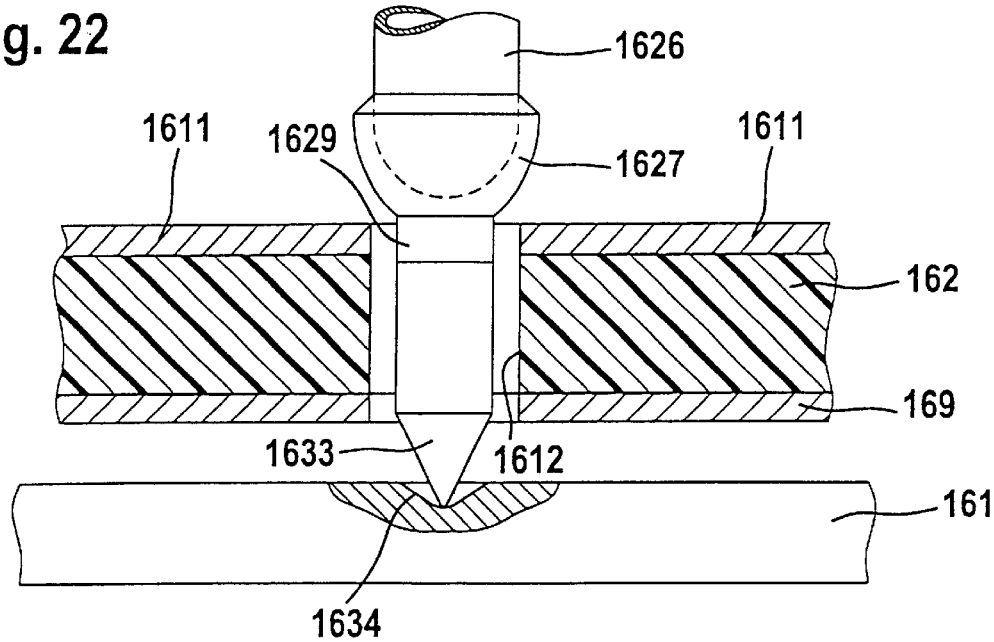
FIG. 22 shows a diagrammatic sectional side view of yet another embodiment.

According to a further embodiment, the device shown only in part, in section and in a side view, in FIG. 22, differs from that according to FIG. 19 primarily in that, in the device according to FIG. 22, the holding extension 1627 is not provided with a blind bore 1628, but with a bearing pivot point 1633 which is inserted into a conical countersink 1634 of the bottom plate 161, the said countersink serving as a step bearing and being positioned coaxially to the perforation 1612 of the appliance base 162. In the embodiment according to FIG. 22, the permanent-magnet body 1629 is located, in a similar way to the embodiment according to FIG. 19, in the region of the upper mouth of the perforation 1612 of the appliance base 162 and, here, lies in the space between the mutually opposite pole pieces 1611.

At the upper end of the treatment vessel 1626, the latter is led through the orifice 1624 of the plate 1621 of the frame 1618 not depicted in FIG. 22, thin plastic wires extending radially inwards in the orifice 1621 from the margin of the latter, the said plastic wires being supported with their inner ends against the outer wall of the treatment vessel 1626 and giving the latter sufficient guidance for the rotation of the structural unit, formed from the treatment vessel 1626 and the holding extension 1627, about the longitudinal axis of the structural unit.

As already mentioned previously, devices of the type proposed here may be designed in such a way that a plurality of treatment vessels are mounted rotatably above an appliance base which can generate a corresponding number of moved magnetic driving fields which in each case come into interaction with drive part arrangements assigned to the individual treatment vessels. Each of the treatment vessels and other holding extensions provided on them is assigned to a bearing device for the rotatable mounting of the treatment vessel and holding extension.

Figure 23:
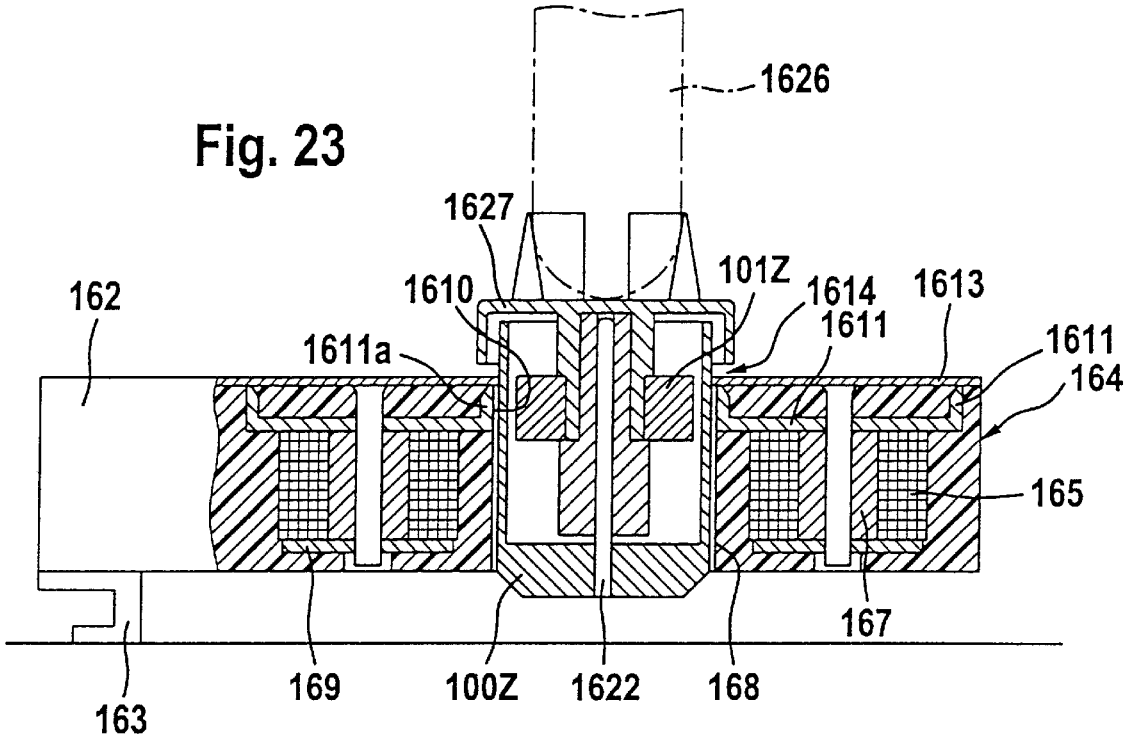
FIGS. 23 to 31 show diagrammatic illustrations of further embodiments or of parts of such embodiments, the said illustrations being shown partly in sectional side view and partly in top view.

The embodiment shown in FIG. 23 constitutes a design which is modified with respect to the embodiments according to FIGS. 19 to 22. The magnetic-field generating system 164 located in the appliance base 162 according to FIG. 23 has a similar design to that shown in FIG. 20, but, as may be gathered from the illustration of FIG. 23 in conjunction with the top view of FIG. 24, the pole pieces 1611 have upwardly bent parts 1611*a* which are grouped around the upper perforation 1610 of the magnetic-field generating system. The remaining parts of the magnetic-field generating system, specifically the magnetic return plate 169 with the lower perforation 168, the cores 167 projecting upwards from the return plate, the exciting windings 165 and a cover plate 1613 laid onto the appliance base 162 supported by feet 163, are identical to the design according to FIGS. 13 and 20.

In the embodiment according to FIG. 23, a plastic bowl-shaped lining 100Z, from the thick-walled bottom of which a bearing pin 1622 projects upwards, is inserted into the orifice 1614 of the cover plate 1613, the said orifice being coaxial to the perforations 168 and 1610 of the magnetic-field generating system 164.

In the embodiment according to FIG. 23, the holding extension 1627 for the or each treatment vessel or test tube 1626 is in the form of a two-part hub, of which the inner hub part provided with a longitudinal bore can be attached with play on the bearing pin 1622. Held between shoulders of the hub parts is a magnetic ring 101Z which is magnetized diametrically in a similar way to the embodiment according to FIG. 21. This is indicated in the top view of FIG. 24, in which, in order to simplify the illustration, parts of the bowl-shaped lining 100Z have been omitted and the permanent-magnet ring 101Z in depicted with an enlarged diameter.

The outer hub part of the holding extension 1627 carries a lid which engages with a flange over the upper end of the bowl-shaped lining 100Z and which prevents moisture from penetrating into the interior of the bowl-shaped lining 100Z. Finally, the holding extension 1627 carries holding arms or receiving parts which project upwards from the said lid and which grasp the lower end of the associated treatment vessel 1626.

Upper rotary mounting means of the device according to FIG. 23 are omitted in the illustration and may belong to the designs described previously.

Figure 24:
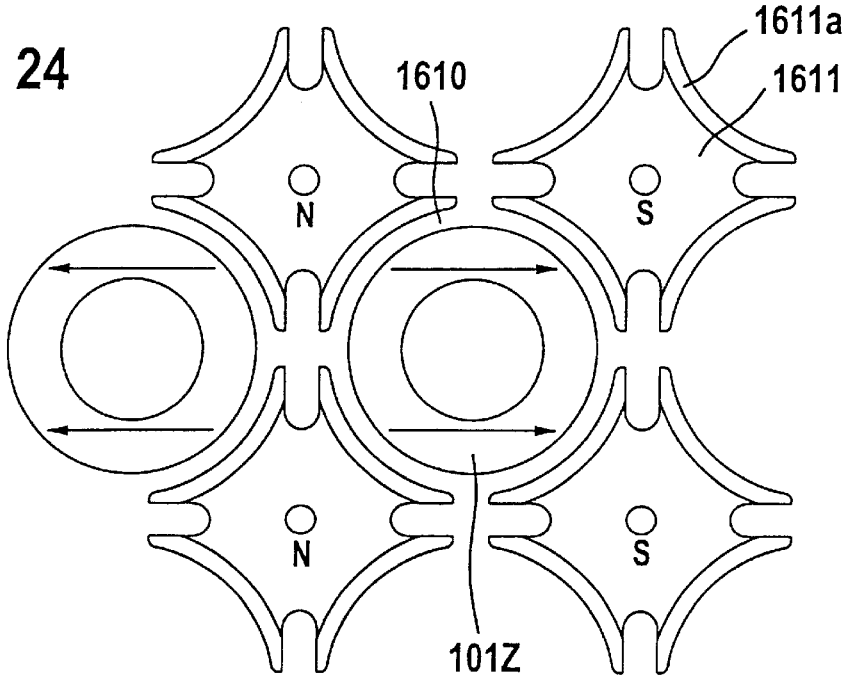

It is notable, in the embodiment according to FIGS. 23 and 24, that the drive means, together with the appliance base 162 provided with a perforation and containing the magnetic-field generating system 164 and together with the permanent-magnet ring 101Z provided on the holding extension 1627, at the same time form the vertical support means for the treatment vessel 1626 and its filling, because the magnetic field formed between the pole-piece parts 1611 is so intensive in the axial region of the perforation of the appliance base that the permanent-magnet ring 101Z and the hub parts of the holding extension 1627 and also the treatment vessel 1626 together with the filling are held suspended, without the bearing pin 1622 giving the holding extension 1626 any axial support.

Figure 25:
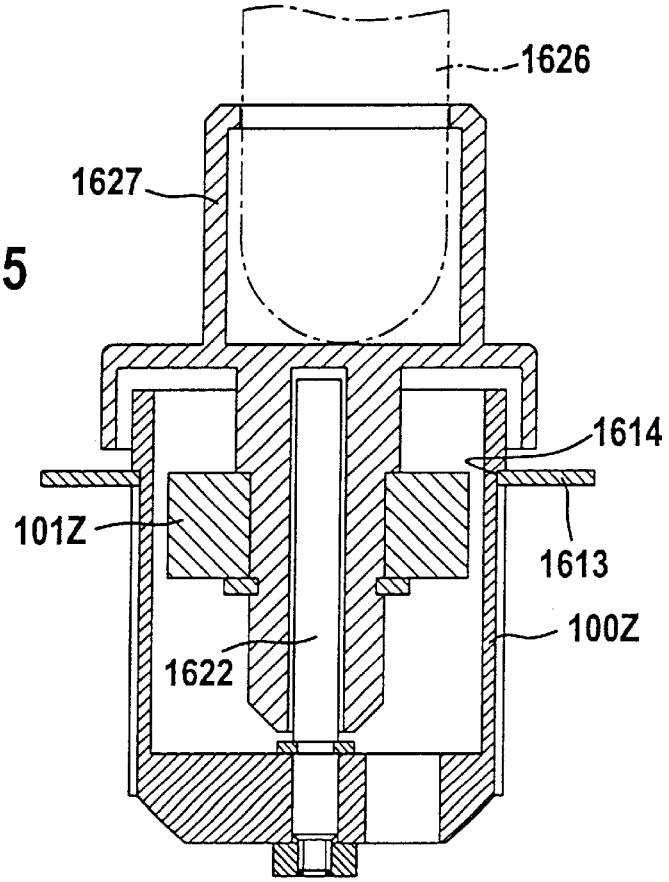
Figure 26:
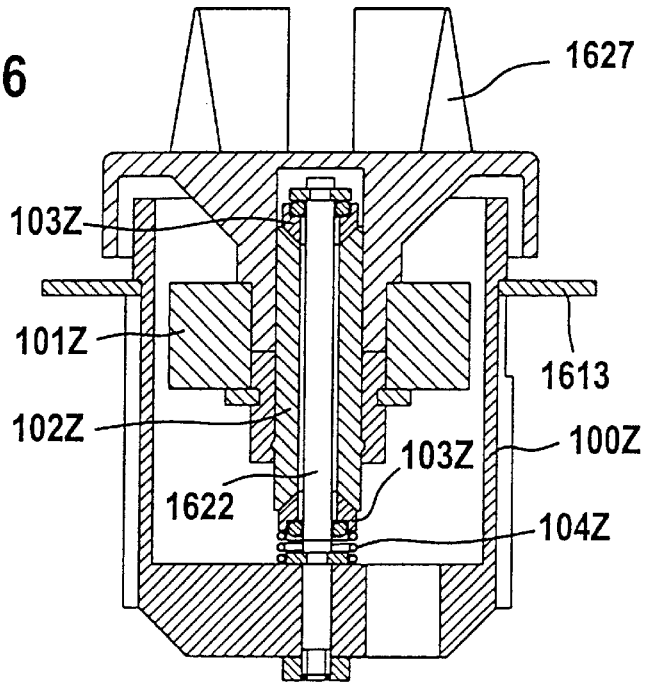

FIGS. 25 and 26 show modification or development of the bowl-shaped lining 100Z and of the holding extension 1627 with respect to the embodiment according to FIG. 23. However, the appliance base and the magnetic-field generating system may once again have the form shown in FIG. 23 and act with the respective generated magnetic rotary field on the diametrically magnetized permanent-magnet ring 101Z. In the embodiment according to FIG. 25, the latter is pushed onto an integrally formed hub of the holding extension 1627 and is retained by means of the spring ring. The bowl-shaped lining 100Z, which is pressed into the orifice 1614 of the cover plate 1613 of the appliance base, serves for supporting the bearing pin 1622 which, here, is inserted into a bore of the bottom of the lining 100Z and is fastened by means of a spring ring and nut. An eccentric receptacle for a treatment vessel 1626 projects upwards from the top side of the plate of the holding extension 1627, said plate engaging over the upper mouth of the lining 100Z, in such a way that the treatment vessel 1626 can be induced to execute wobbling movements with the cooperation of a rotary mounting provided at the upper end of the treatment vessel 1626 and coaxial to the bearing pin 1622, this being desirable for specific treatment operations in a liquid filling of the treatment vessel 1626.

During operation, the upper end of the bearing pin 1622 is at a distance from the end of the coaxial bearing bore or the hub of the holding extension 1627, and there is likewise a distance between the lower end of the hub and the bottom of the bowl-shaped lining 100Z, from which it is apparent that, during operation, the magnetic rotary field of the magnetic-field generating system holds the permanent-magnet ring 101Z, and also the holding extension 1627 firmly connected to the latter, axially in suspension.

The shape of the holding extension 1627 in the embodiment according to FIG. 26 is essentially identical to the relevant design in the embodiment according to FIG. 23. The same applies to the form of the bowl-shaped lining 100Z and to the magnetic-field generating system interacting with the diametrically magnetized permanent-magnet ring 101Z. However, in the embodiment according to FIG. 26, the bearing pin 1622 does not bear directly on the wall of an axial bore of the hub of the holding extension 1627, but is led with slight play through a sleeve 102Z which is inserted into this axial bore and which has in each case conical end faces. Centring rings 103Z are laid against these conical faces and have corresponding conical end faces, the said centring rings being provided at the upper end and at the lower end of the bearing pin 1622 and being prestressed towards one another with slight pressure by a helical spring 104Z which is provided at the lower end of the bearing pin 1622 and which encircles the latter. There is no need for a secure rotationally fixed connection between the centring rings 103Z and the bearing pin 1622. Due to the supporting force exerted on the permanent-magnet ring 101Z by the magnetic-field generating system, the centring rings 103Z and, in particular, also the helical compression spring 104Z do not have to absorb axial supporting forces as a result of the weight of the holding extension, of the treatment vessel inserted in the latter and of its filling. Instead, the centring rings 103Z bring about with their conical end faces, in interaction with the conical end faces of the sleeve 102Z, centring and vibration damping, even at very high rotational speeds of the magnetic rotary field and therefore very high rotational speeds of the holding extension and treatment vessel.

The embodiments according to FIGS. 27 to 32 make use, in a similar way to the embodiments according to FIGS. 23 to 26, of the supporting action emanating from the intensive magnetic rotary field which is built up by a magnetic-field generating system of an appliance base provided with continuous perforations and which interacts with a magnetic body or magnetic ring which is provided on a treatment vessel or a holding extension coupled to the latter. In addition, however, the design of the embodiments according to FIGS. 27 to 32 implements a stirring and intermixing principle of independent significance, without complicated vertical support means and with an extremely simple design of the rotary mounting means, which is dealt with in detail below.

It was stated previously that, when treatment vessels resembling test tubes rotate about their longitudinal mid-axis, liquid layers near the vessel inner wall are first entrained in rotation more quickly, whereas the liquid layers nearer the axis of rotation lag behind, in such a way that the shearing forces in the liquid volume assist intermixing or other treatment operations promoted by rotation. However, this effect is lost in the stationary state, when the entire liquid finally rotates in synchronism with the treatment vessel. For this reason, in the embodiments described hitherto, it is expedient to vary, in particular, periodically, the rotational speed of the treatment vessels or, if appropriate, change the direction of rotation.

However, if, for example, a translational movement takes place in the cylindrical treatment vessel, in such a way that all points on the longitudinal mid-axis of the treatment vessel describe circular paths located in horizontal planes, it can be seen that, as a result of such a translational circular movement, a liquid filling is first urged towards the vessel inner wall on one side due to the centrifugal forces and then begins to rotate in the vessel in the direction predetermined by the translational circular movement.

If a rotational movement about the longitudinal mid-axis of the treatment vessel in the opposite direction is then superposed on the translational circular movement of the vessel, even in the stationary state shearing forces constantly act between liquid layers of the liquid filling which are adjacent to one another in the radial direction, and a highly intensive intermixing effect is obtained.

Figure 27:
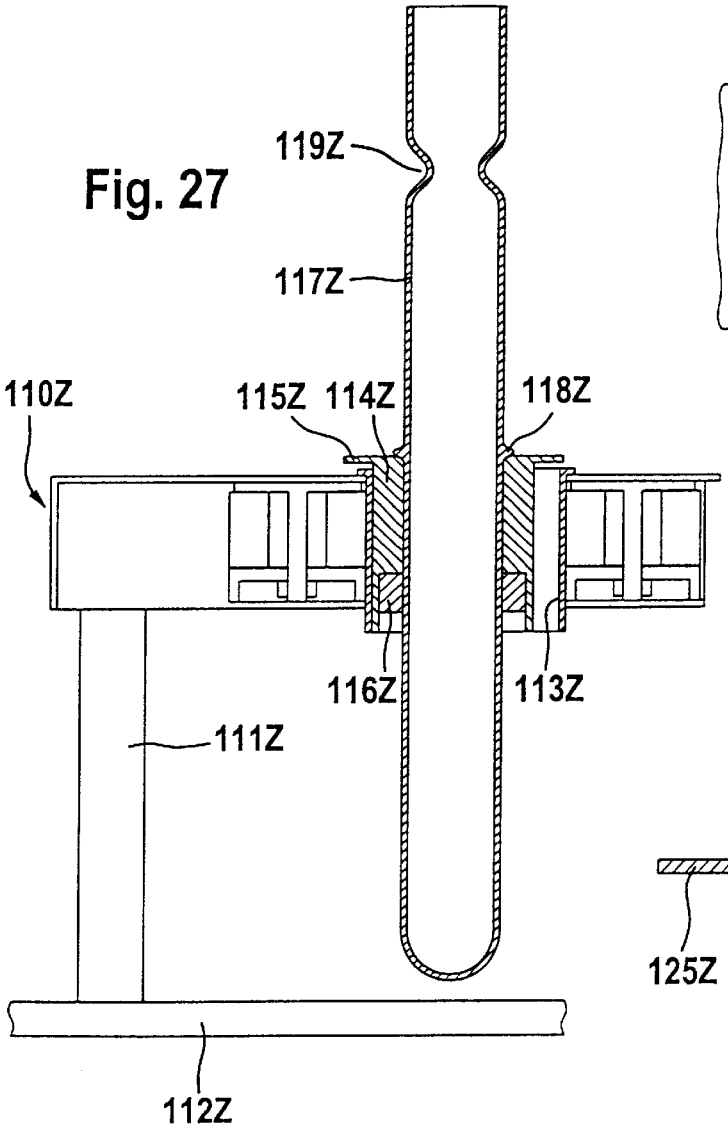

In order to implement this principle, there is provided, in the embodiment according to FIG. 27, an appliance base, designated here by 110Z, which, as regards the design of the magnetic-field generating system with a magnetic return plate or yoke plate, cores projecting from the latter, exciting coils surrounding the cores and pole pieces fastened to the cores, corresponds to the design of the embodiment according to FIG. 23, but where, in the magnetic-field generating system, the magnetic return plate or yoke plate is arranged on the top side and the pole pieces are arranged on the underside. Moreover, perforations in the magnetic return plate or yoke plate and in the arrangement of the pole pieces, the said perforations delimiting a cylindrical vertical space lined by a sleeve, have a significantly larger diameter than in the embodiment according to FIG. 23, as is readily apparent from FIG. 27.

Figure 28:
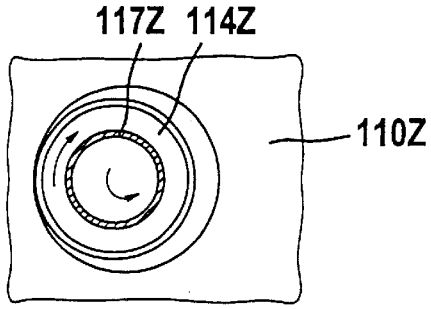

The appliance base 110Z is supported at a relatively great height above a bottom plate 112Z by means of feet 111Z. A hollow-cylindrical treatment vessel holder 114Z is inserted into the cylindrical space, designated here by 113Z, within the sleeve lined with the passage duct of the appliance base 110Z, the outside diameter of the said treatment vessel holder having a substantially smaller diameter than the cylindrical space 113, as is evident from FIG. 27 and also from the partial top view of FIG. 28 depicted partially in horizontal section.

The treatment vessel holder 114Z carries, at its upper end, a radial flange 115Z, the outside diameter of which is larger than the diameter of the cylindrical space 113Z and which, with the device switched off, is seated on the upper end of the lining sleeve of the cylindrical space 113Z. A ring 116Z made of ferromagnetic material is embedded into the treatment vessel holder 114Z.

The bore of the hollow-cylindrical treatment vessel holder 114Z and the perforation of the ferromagnetic ring 116Z have essentially the same diameter. Pushed through the treatment vessel holder 114Z of the ferromagnetic ring 116Z is the lower part of a treatment vessel 117Z which is essentially in the form of a test tube and which is supported with a collar 118Z against the top side of the treatment vessel holder 114Z. Near the upper orifice of the treatment vessel 117Z, the latter has an all-round contraction 119Z which performs the function already explained, for example, with reference to FIG. 17 and which prevents a filling of the treatment vessel 117Z from being thrown out when the liquid filling rises on the wall of the treatment vessel with the assistance of the centrifugal forces.

When the exciting coils of the magnetic-field generating system are supplied with current in such a way that the magnetic-field generating system builds up an intensive magnetic rotary field in the cylindrical space 113Z, the ferromagnetic ring 116Z is drawn in the direction of the wall of the cylindrical space 113Z and, moreover, the ferromagnetic ring 116Z, together with the treatment vessel holder 114Z, is lifted into the region between the pole pieces of the magnetic-field generating system, as may be seen in FIG. 27 from the distance between the radial flange 115Z and the upper end of the lining sleeve of the cylindrical space 113Z. When the magnetic rotary field advances in the circumferential direction as a result of appropriate activation of the exciting windings of the magnetic-field generating system, the treatment vessel holder 114Z rolls on the inner wall of the cylindrical space 113Z, as indicated in FIG. 28 by the radially outer arrow, the treatment vessel 117Z at the same time executing a rotation according to the radially inner arrow depicted in FIG. 28.

The arrangement is such that during operation, the centre of gravity of the treatment vessel 117Z and of the filling, which is deformed under the centrifugal forces, is in the axial region occupied by the appliance base 110Z. The arrangement shown in FIG. 27 therefore requires no additional rotary mounting and vertical support means and is distinguished by particularly simple and uncomplicated design.

Figure 29:
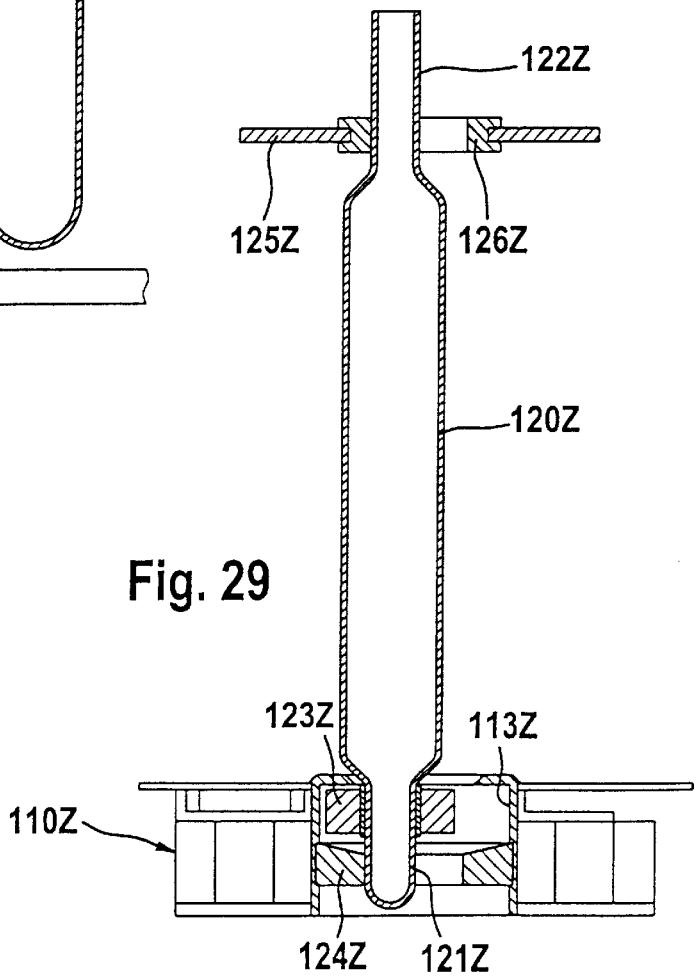

The embodiment according to FIG. 29 makes use of a treatment vessel 120Z which has a middle portion of larger diameter and a lower extension 121Z of smaller diameter as well as a neck extension of the middle portion, the said neck extension leading to the vessel orifice and having a smaller diameter and being designated by 122Z.

Pushed onto the lower extension 121Z of the treatment vessel 120Z is a ferromagnetic ring 123Z which, together with the lower extension 121Z of the treatment vessel 120Z, is located in a cylindrical space, also designated here by 113Z, within a lining sleeve of a perforation of the magnetic-field generating system which has a design corresponding to that of the embodiment according to FIG. 27, although here, once again, the pole pieces are located on the top side of the appliance base designated by 110Z. The ferromagnetic ring 123Z lies at the level of the pole pieces. Below the region occupied by the ferromagnetic ring 123Z, a bearing ring l24Z is fastened in the cylindrical space 113Z in such a way that the passage orifice of the ring 124Z is coaxial to the cylindrical space 113Z.

A holding plate 125Z is located above the appliance base 110Z, at a distance from the latter which is greater than the axial length of the middle portion of the treatment vessel 120Z, on a frame, not shown, which is connected to the appliance base, the said holding plate being provided with an orifice coaxial to the axis of the ring 124Z and of the cylindrical space 113Z. Inserted into this orifice is a bearing support ring 126Z, the passage orifice of which has the same diameter as the passage orifice of the bearing support ring 124Z.

When the magnetic-field generating system generates a magnetic rotary field in the cylindrical space 113Z of he appliance base, the ferromagnetic ring 123Z at the lower extension 121Z of the treatment vessel 120Z is drawn towards the inner wall of the cylindrical space 113Z on one side and is guided all-round along this inner wall in synchronism with the magnetic rotary field. At the same time, the outer wall of the lower extension 121Z rolls on the inner circumference of the bearing support ring 124Z and the outer wall of the neck extension 122Z of the treatment vessel 120Z, the said neck extension having an identical diameter, simultaneously rolls on the inner circumference of the bearing support ring 126Z, with the result that the treatment vessel 120Z executes exactly corresponding movements, as was explained previously with regard to the treatment vessel 117Z of the embodiment according to FIGS. 27 and 28. By an appropriate choice of the diameters of the bearing support rings, on the one hand, and of the portions of smaller diameter of the treatment vessel, on the other hand, the ratio between the rotation of the magnetic rotary field and the counter-rotation of the treatment vessel about its longitudinal axis can be adjusted.

It goes without saying that, in the embodiments according to FIGS. 27 to 29, if they are designed with only a single treatment vessel jolting forces or vibrations acting in the horizontal direction occur.

In a matrix arrangement consisting of a multiplicity of magnetic-field generating systems and of associated treatment vessels, such jolting forces or vibrations can be avoided altogether if the individual magnetic-field generating systems and associated treatment vessels are arranged in groups of four, in which the treatment vessels together with their fillings and the parts of the drive means which move together with the treatment vessels execute symmetrical movements which are in phase opposition.

Figure 30:
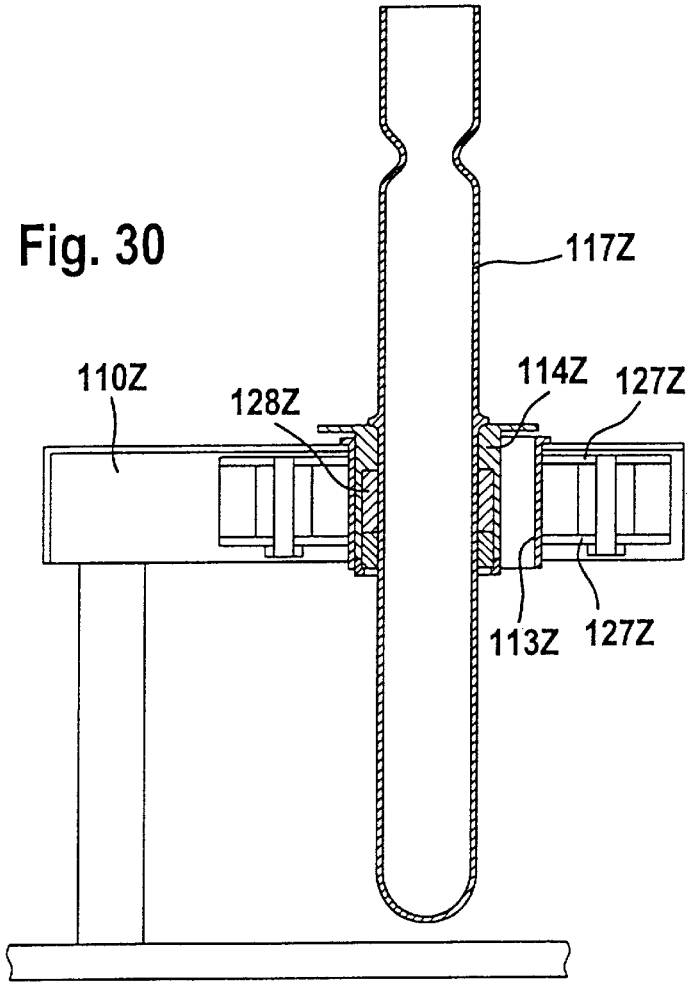
Figure 31:
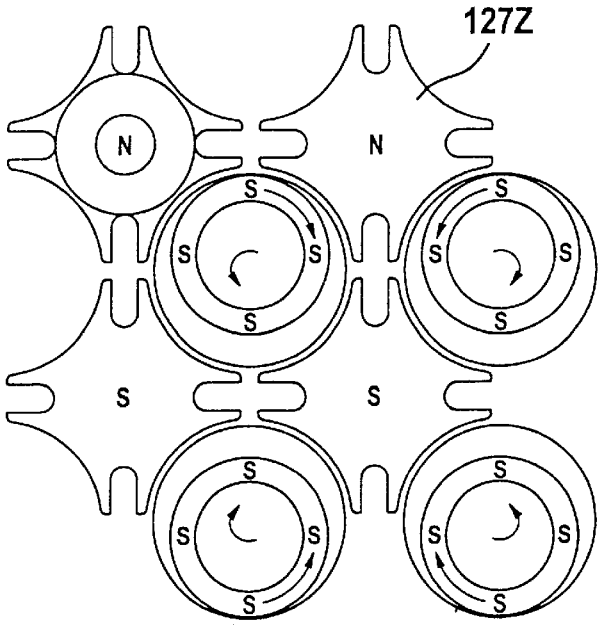

For this purpose, the embodiment according to FIGS. 30 and 31 which is comparable to the embodiment according to FIGS. 27 and 28, parts corresponding to one another also being given the same reference numerals, there are provided within the appliance base 110Z magnetic-field generating systems, in which pole pieces having a shape which may be gathered, for example, from the illustration of a top view in FIG. 31 are fastened both to the top side and to the underside of the exciting coils of a magnetic-field generating systems at the cores encircled in each case by the exciting coils. The embodiment according to FIGS. 30 and 31 therefore does not contain any magnetic return plate or yoke plate of the magnetic-field generating system. Furthermore, the treatment vessel holder 114Z of the embodiment according to FIGS. 30 and 31 differs from the corresponding part of the embodiment according to FIGS. 27 and 28 in that, in this case, instead of the ferromagnetic ring 116C, an axially polarized permanent-magnet ring 128Z is embedded into the treatment vessel holder 114Z in such a way that, during operation, the permanent-magnet ring 128Z comes to lie in the axial region between the upper and lower pole pieces 127Z.

If, then, exciting windings of the magnetic-field generating systems are supplied with current waves in such a way that opposed magnetic rotary fields occur in pairs, within a group four, in the cylindrical spaces 113Z of the appliance base 110Z which are assigned to the individual treatment vessels, the axially magnetized permanent-magnet rings 128Z are oriented in the way apparent from FIG. 31 and cause the treatment vessel holders 114Z and the associated treatment vessels 117Z, together with the liquid fillings located in them, to execute opposed rotational movements which are in phase opposition, so that the jolting forces and vibrational forces within the arrangements of treatment vessels in fours are compensated. It goes without saying that this principle can also be applied to devices of the type discussed in connection with FIG. 29, for which purpose, instead of the ferromagnetic ring 123Z, an axially lower-placed axially magnetized permanent-magnet ring is to be provided on the lower extension 121Z of the treatment vessel 120Z, the magnetic-field generating systems are to have upper and lower pole pieces and the bearing support ring 124Z is once again to be arranged below the level of the magnetic-field generating system and interacts with a prolongation of a lower extension of the treatment vessel.

What is claimed is:

1. Device for stirring, intermixing or agitating liquids, especially also for the purpose of temperature control, concentration and centrifuging, with a vessel for receiving the liquid, which is elongated along an essentially vertical axis of symmetry and has a lower end and a filling orifice at an upper end with vertical support means for absorbing at least some of the weight of the vessel and the liquid, with rotary mounting means for positioning and guiding the vessel during rotation about its essentially vertical axis of symmetry, and with drive means for generating the rotation of the vessel, characterized in that the rotary mounting means are associated with centring and stabilizing means which exert in a clearance, between said rotary mounting means and an outer wall of said vessel, centring and stabilizing forces acting on the vessel.

2. Device according to claim 1, characterized in that the centring and stabilizing means associated with said rotary mounting means are located at the lower end of the vessel.

3. Device according to claim 2, characterized in that a cylindrical sleeve is pushed onto the lower end of the vessel, into the lower end of which sleeve extends a bearing tenon which projects upwards from an appliance base and which has a circumferential bead located with clearance adjacent the sleeve inner wall.

4. Device according to claim 1, characterized in that the lower end of the vessel is designed as a bearing cap or is provided with a coaxial integrally formed bearing pin, a lower end of the bearing cap or of the bearing pin engaging into a step bearing which is provided in an appliance base and which, with the lower vessel end or the pin, forms the vertical support means.

5. Device according to claim 1, characterized in that the centring and stabilizing means are associated with upper rotary mounting means.

6. Device according to claim 5, characterized in that the centring and stabilizing means are formed by a ring with an inner edge located with clearance adjacent the vessel outer wall and by dampingly resilient intermediate parts which absorb vibration by virtue of friction and which are provided between the vessel and a holding plate, fixed to a frame.

7. Device according to claim 5, characterized in that the centring and stabilizing means are formed by a springily and dampingly resilient annular disc, which is clamped between two plate parts of a holding plate and which reaches with its inner edge from an edge of plate-part bores concentric to the axis of symmetry of the vessel near to an outer wall of the vessel, or by an annular damper disc which projects from the vessel and covers a passage bore of a holding plate fixed to a frame and which rests slidably on the bore edge.

8. Device according to claim 5, characterized in that the centring and stabilizing means contain a magnetic ring, which is pushed onto the upper end of the vessel, and an annular end face which forms a south pole, and at least three magnetic bodies which are arranged at an equal circumferential interval along the edge of a bore of a holding plate, the bore being concentric to the axis of symmetry of the vessel, and which have magnetization in the same direction as the magnetization of the magnetic ring and hold the magnetic ring coaxially to the bore by means of forces of repulsion.

9. Device according to claim 5, characterized in that the wall of the vessel has, in the region of the filling orifice, a turned-round rim extension, into which extends from below a tubular extension, the cylindrical outer wall of said tubular extension is located with clearance adjacent the cylindrical inner wall of the turned-round rim part and projects upwards from the edge of a bore of a holding plate, the bore being approximately concentric to the axis of symmetry of the vessel.

10. Device according to claim 5, characterized in that at the upper end of the vessel, near its filling orifice, is located a magnetic ring which is pushed onto the vessel or is embedded or anchored in a lid part inserted into the filling orifice and which has, on a lower side of a downwardly pointing annular end face, alternating north and south poles generated by corresponding magnetization and is provided, on an upper side of the annular end face, with a magnetic return ring, in that the lower side of the annular end face of the magnetic ring has located adjacent thereof end faces of upwardly bent pole shoes of poles of a magnetic-field generating system fixed to a frame, the poles generating a rotating driving magnetic field, and in that the lower end of the vessel is supported by the vertical support means, in such a way that the forces of attraction between the magnetic ring and the pole shoes of the magnetic-field generating system draw the vessel towards the vertical support means and prevent the vessel from floating in a liquid bath.

11. Device according to claim 10, characterized in that exciting windings of the magnetic-field generating system are arranged at a level near the filling orifice of the vessel and in that a magnetic return plate, which connects the lower ends of the pole cores to one another, is arranged either in an appliance base or at a comparatively short distance below the pole shoes.

12. Device according to claim 11, characterized in that a liquid tank is provided for receiving a liquid bath which surrounds the vessel to a level below the exciting windings of the magnetic-field generating system or of magnetic-field generating systems.

13. Device according to claim 10, characterized in that the magnetic ring or a magnetic system ring is partially surrounded by a magnetic screening ring, consisting of magnetically soft material, in such a way that an end face of the magnetic ring or magnetic system ring which presents the different magnetic poles is exposed, whilst the magnetic ring or magnetic system ring is covered by the magnetic screening ring on outer faces thereof emitting stray magnetic fields, so that, within a matrix arrangement of vessels and associated magnetic-field generating systems, mutually adjacent systems consisting of vessels with associated magnetic rings or magnetic system rings do not influence one another.

14. Device according to claim 1, characterized in that a treatment device rotating together with the vessel is inserted into the filling orifice of the vessel.

15. Device according to claim 14, characterized in that the treatment device is in the form of a cooling head which is manufactured from thermally conductive material and which projects with a heat-exchange body provided with ribs, into the vessel interior and is connected to a fan-wheel body which projects beyond the filling orifice of the vessel and which operates as a radial fan and, by being connected to the heat-exchange body, extracts heat therefrom in order to cool the liquid in the vessel.

16. Device according to claim 15, characterized in that an axial duct connecting the centre of the fan-wheel body to the interior of the vessel extends through the fan-wheel body and the heat-exchange body, there being provided along the axial duct a chamber which serves as a bubble and condensate trap and which is connected to the vessel interior by means of return ducts running radially outwards and obliquely downwards.

17. Device according to claim 1, characterized in that the vertical support means are formed by a bearing cap or bearing pivot point at the lower end of the vessel or on a carrier coupled to the lower end of the vessel, and by step bearing or an essentially flat bearing supporting face having a lower curvature than the bearing cap or bearing pivot point.

18. Device according to claim 17, characterized in that a heat supply device is located at the lower end of the vessel and a cooling device is located at the upper end of the vessel.

19. Device according to claim 18, characterized in that the heat supply device comprises a bearing tenon heated via an appliance base and fixed to a frame and a carrier mechanically and thermally coupled to the vessel.

20. Device according to claim 18, characterized in that the heat supply device contains discs or cylinders projecting from a frame and capable of being heated via the appliance base, and discs or cylinders provided on the carrier for the vessel and located opposite the frame projecting discs or cylinders at a distance from the frame projecting discs or cylinders.

21. Device according to claim 17, characterized in that the lower end of the vessel is immersed in a heated liquid bath.

22. Device according to claim 17, characterized in that a disturbing shutter having a perforation adapted to the diameter of the vessel is movable axially from a position of rest into an operating position, in which, because play between the perforation of the disturbing shutter and the wall of the vessel has become smaller, the vessel executes rattling vibrations during rotation.

23. Device according to claim 17, characterized in that a plurality of vessels, vertical support means, rotary mounting means and drive means are arranged in a matrix.

24. Device according to claims 17, characterized in that the vessel rotates at such a rotational speed, preferably above 3,000 1/min, that, in the case of a support of its lower end or of a carrier connected to the lower end of the vessel, the vessel rotates as a gyroscope and, apart from the vertical support, essentially contactlessly.

25. Device according to claim 17, characterized in that an insert vessel for receiving the liquid to be treated can be pushed axially into the vessel.

26. Device according to claim 1, characterized in that the vertical support means are formed by a step bearing of low curvature or by an upward bore on or in a carrier coupled to the vessel lower end, and by a bearing tenon projecting upwards from an appliance base or from an appliance base part and having an upper bearing cap or bearing pivot point.

27. Device according to claim 1, characterized in that the centring and stabilizing means contain a slotted plastic ring which surrounds the vessel when centred with play and which is connected, via at least one elastic bridge or spoke, to a carrier body securable or fastened to a frame or is prestressed towards the lower vessel end by spring means.

28. Device according to claim 1, characterized in that the centring and stabilizing means contain a magnetic system ring pushed onto the vessel and a ferromagnetic counter-ring spaced apart from a vertical axis of said magnetic system ring and exerting forces of attraction on the magnetic system ring.

29. Device according to claim 28 characterized in that the magnetic system ring or the counter-ring contains a continuous yoke ring and diametral portions in the form of a section of an annulus of an extent of less than 180°, which are affixed axially to the said yoke ring and are in each case polarized axially adjacent to one another, and in that the counter-ring or, correspondingly, the magnetic ring contains a ferromagnetic continuous ring mounted so as to be fixed to a frame or else a ring arrangement of pole pieces which are in the form of a sector of an annulus and which are an integral part of a magnetic-field generating system of the drive means.

30. Device according to claim 29, characterized in that the magnetic system ring or the ferromagnetic counter-ring at the lower end of the vessel is pushed onto the lower end of the vessel or is fastened to a carrier coupled to the vessel, and in that the counter-ring or magnetic system ring fixed to the frame has a diameter larger than that of the magnetic system ring or counter-ring on the vessel and is located axially therebelow, in that the support point is at such an axial distance from an interspace between the counter-ring and magnetic system ring that an oblique position of a plane of the rings relative to one another moves their end faces away from one another in mutually opposite circumferential regions.

31. Device according to claim 1, characterized in that the drive means has a plate-body arrangement which is provided with a perforation for the vessel and which contains exciting coils for a magnetic rotary-field generating system, a yoke plate provided with a perforation for the passage of the vessel and pole-shoe arrangements coupled to the exciting coils and having pole pieces surrounding the perforation.

32. Device according to claim 1, characterized in that the vessel can be inserted from above into a carrier having the support means and locked.

33. Device according to claim 32, characterized in that the support means or a bearing tenon projecting upwards from an appliance base is of springy design and include a spring excursion limited by stop means.

34. Device according to claim 32, characterized in that the carrier has a circumferential flange which is superposed by a shutter which, when the vessel and carrier are separated, retains said flange.

35. Device according to claim 1, characterized in that the drive means comprises a magnetic field generating system and contains an appliance base generating a rotating magnetic driving field and a magnetically hard and soft driving part arrangement coupled to the vessel and coming into interaction with the moved magnetic driving field of the appliance base, and in that the vertical support means have a holding extension which also forms part of the rotary mounting means and extends downwards at the lower end of the vessel along the longitudinal axis of the vessel and which contains a mounting part of the bearing device, consisting of a bearing pivot point or bearing shaft and of a step bearing or bearing sleeve, and the driving part arrangement, the holding extension extending through a perforation of the appliance base which contains either near its top side or near its underside, in the region of this perforation, the poles of the magnetic-field generating system which generate the rotating magnetic driving field, and the driving part arrangement being located essentially vertically level with these poles.

36. Device according to claim 35, characterized in that below or at the appliance base is provided a bottom plate which carries either the step bearing or bearing sleeve for the bearing pivot point or bearing shaft of the holding extension or the bearing pivot point or bearing shaft for the step bearing or bearing sleeve of the holding extension.

37. Device according to claim 35, characterized in that the appliance base has placed on it a cover plate which has an orifice corresponding to the perforation of the appliance base and a lining of the perforation of the appliance base, the said lining being inserted into the orifice or integrally adjoining the edge thereof and being open or provided with a bottom.

38. Device according to claim 35, characterized in that a frame can be placed onto the appliance base or onto a cover plate of the appliance base, the frame having, at a level near the upper end of the vessel a plate with an orifice which is vertically coaxial with the perforation of the appliance base, wherein an inner edge of the orifice is closely spaced from the outer wall of the vessel.

39. Device according to claim 38, characterized in that elastically resilient support means, as centring and stabilizing means, from the edge of the orifice of the plate of the frame are close to the outer wall of the vessel.

40. Device according to claim 35, characterized in that the holding extension is releasbly connected to the vessel and can be coupled thereto by locking.

41. Device according to claim 35, characterized in that, in addition to the vessel, it contains a series of identically designed vessels, associated holding extensions and bearing devices in that, in addition to the magnetic driving field, further magnetic driving fields assigned to each vessel can be generated by means of the appliance base.

42. Device according to claim 35, characterized in that a bearing pin, which extends into a bearing bore of the holding extension, projects upwards from a bottom of a lining sleeve inserted into the perforation of the appliance base, and in that the driving part arrangement is in the form of a diametrically magnetized permanent-magnet ring which is entrained by the magnetic rotary field of the magnetic-field generating system, the rotary field being generated between pole pieces, and at the same time is lifted, together with the holding extension, the vessel and liquid therein.

43. Device according to claim 42, characterized in that the holding extension has a hub part containing the bearing bore for the bearing pin and a lid which is provided at an upper end of the said hub part and engages over a mouth of the lining sleeve and from a top side of which projects upwards a concentric or eccentric holding device grasping the vessel at the lower end thereof.

44. Device according to claim 43, characterized in that a sleeve with conical end faces is inserted into an axial bore of the hub part of the holding extension, in that the bearing pin extends with play through a bore of the sleeve, and in that upper and lower centring rings seated on the bearing pin and having conical end faces are pressed with slight prestressing force against the corresponding conical end faces of the sleeve.

45. Device according to claim 1, characterized in that the drive means comprises a magnetic-field generating system and contains an appliance base generating a rotating magnetic driving field and a magnetically hard or soft driving part arrangement, coupled to a treatment device and coming into interaction with the moved magnetic driving field of the appliance base, the appliance base having a perforation and containing near its top side and/or near its underside, in the region of this perforation, the poles of the magnetic-field generating system which generate the rotating magnetic driving field, and the driving part arrangement being located essentially vertically level with these poles or vertically level with and between these poles and, together with the magnetic-field generating system, also forming the vertical support means, and in that, furthermore, an inside diameter of the perforation of the appliance base is larger than an outside diameter of a hollow-cylindrical treatment vessel holding ring, or else in that an inside diameter of a bearing support ring inserted into the perforation is larger than an outside diameter of a vessel extension having a reduced diameter, in such a way that, when the driving part arrangement is driven by the rotating magnetic driving field, the longitudinal axis of the vessel is moved on circular paths located in horizontal planes, whilst at the same time, due to the rolling of the treatment vessel holding ring on an inner face of the perforation or a rolling of an outer face of a shoulder of the vessel on an inner face of the bearing support ring, the vessel rotates about its longitudinal axis in a direction opposite a first rotational direction.

46. Device according to claim 45, characterized in that the driving part arrangement is formed by an axially magnetized permanent-magnet ring which is embedded into the vessel holding ring which, during operation, is located at a vertical level between upper and lower pole pieces of the magnetic-field generating system.

47. Device according to claim 46, characterized in that, in addition to the vessel, it contains a series of identically designed vessels and associated magnetic-field generating systems arranged in groups of four, wherein exciting windings of the magnetic-field generating systems are supplied with phase-shifted alternating currents, in such a way that the vessels, together with their liquids, execute, in pairs adjacent to one another, opposed movements which are in phase opposition.

* * * * *